US010845729B2

(12) United States Patent
Wakisaka et al.

(10) Patent No.: US 10,845,729 B2
(45) Date of Patent: Nov. 24, 2020

(54) IMAGE FORMING APPARATUS HAVING TONER DENSITY CONTROL

(71) Applicant: CANON KABUSHIKI KAISHA, Tokyo (JP)

(72) Inventors: Masashi Wakisaka, Misato (JP); Yusuke Ishida, Toride (JP); Takanori Iida, Noda (JP); Katsuya Nose, Kashiwa (JP); Yuta Okuyama, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/260,612

(22) Filed: Jan. 29, 2019

(65) Prior Publication Data

US 2019/0243280 A1 Aug. 8, 2019

(30) Foreign Application Priority Data

Feb. 7, 2018 (JP) ..... 2018-020398

(51) Int. Cl.
*G03G 15/08* (2006.01)
*G03G 15/09* (2006.01)

(52) U.S. Cl.
CPC ..... *G03G 15/086* (2013.01); *G03G 15/0849* (2013.01); *G03G 15/09* (2013.01)

(58) Field of Classification Search
None
See application file for complete search history.

(56) References Cited

U.S. PATENT DOCUMENTS 7,010,237 B2 3/2006 Suzuki et al.
7,027,746 B2 4/2006 Suzuki et al.
(Continued)

FOREIGN PATENT DOCUMENTS

JP H02-21591 B2 5/1990
JP 06242680 A * 9/1994
(Continued)

OTHER PUBLICATIONS

JP_06242680_A_T Machine Translation, Sep. 1994, Japan (Year: 1994).*
(Continued)

*Primary Examiner* — Victor Verbitsky
(74) *Attorney, Agent, or Firm* — Venable LLP

(57) ABSTRACT

An image forming apparatus includes a permeability sensor configured to detect information on magnetic permeability of developer contained in a developer container for detecting toner density of the developer, and a controller configured to control a control voltage applied to the permeability sensor so that (i) a value of the control voltage that is applied to the permeability sensor in a case where a predetermined condition including a condition that the toner density of the developer contained in the developer container is a predetermined density is satisfied and an amount of the developer contained in the developer container is a first amount is greater than (ii) a value of the control voltage applied to the permeability sensor in a case where the predetermined condition is satisfied and the amount of the developer contained in the developer container is a second amount greater than the first amount.

9 Claims, 19 Drawing Sheets

(56) References Cited

U.S. PATENT DOCUMENTS

| | | | |
|---|---|---|---|
| 7,512,348 | B2 | 3/2009 | Suzuki et al. |
| 7,536,120 | B2 | 5/2009 | Ishida |
| 7,664,435 | B2 | 2/2010 | Nose |
| 9,354,577 | B2 | 5/2016 | Nose et al. |

FOREIGN PATENT DOCUMENTS

| | | | |
|---|---|---|---|
| JP | 2000-206775 | A | 7/2000 |
| JP | 2003-295598 | A | 10/2003 |
| JP | 2005-258305 | A | 9/2005 |
| JP | 2014-126595 | A | 7/2014 |

OTHER PUBLICATIONS

JP_2005258305_A_T Machine Translation, Sep. 2005, Japan (Year: 2005).*
Yusuke Ishida et al., U.S. Appl. No. 16/281,288, filed Feb. 21, 2019.

* cited by examiner

IMAGE FORMING APPARATUS HAVING TONER DENSITY CONTROL

BACKGROUND OF THE INVENTION

Field of the Invention

The present invention relates to an image forming apparatus that utilizes an electrophotographic system, such as a printer, a copying machine, a facsimile or a multifunction printer.

Description of the Related Art

Image forming apparatuses that utilize an electrophotographic system include a developing unit that uses a two-component developer including nonmagnetic toner (hereinafter simply referred to as toner) and magnetic carrier (hereinafter simply referred to as carrier) to develop an electrostatic latent image formed on a photosensitive drum into a toner image. For developing units, replenishment control where developer for replenishment, i.e., replenishing developer, is replenished from a replenishment unit based on toner density of developer (that is, ratio of toner with respect to a total amount of developer) in a developing unit is performed to supply toner that is consumed by image development and also to supply and replace carrier. In order to detect the toner density of developer, a permeability sensor, also referred to as an inductance sensor, is provided in the developing unit, as described in Japanese Patent Application Laid-Open Publication No. 2003-295598.

In the permeability sensor described above, magnetic permeability, which changes depending on toner density in the developer, is detected and an electric detection signal is output. However, it is known that the detection signal of the permeability sensor also varies depending on bulk density of developer. That is, even in the cases where the toner density of developer is constant, if the amount of developer in the developing unit increases and the bulk density of developer increases, the detection signal of the permeability sensor also increases, and in that case, estimated value of toner density based on the detection signal will become lower than the actual toner density. In contrast, if the amount of developer in the developing unit decreases and the bulk density of developer drops, the detection signal of the permeability sensor becomes low, and in that case, estimated value of toner density based on the detection signal will be higher than the actual toner density. As described, the detection signal of the permeability sensor varies depending on the amount of developer in the developing unit, and as a result, erroneous detection of toner density may occur. Then, various controls including replenishment control that are performed based on the detection signal acquired by the permeability sensor may not be performed properly.

SUMMARY OF THE INVENTION

According to one aspect of the present invention, an image forming apparatus includes: an image bearing member configured to bear an electrostatic latent image formed thereon; and a developing unit configured to develop the electrostatic latent image formed on the image bearing member. The developing unit includes: a container configured to contain developer including nonmagnetic toner and magnetic carrier, a first amount of the developer being sealed in the container in an initial state where the developing unit is not yet used; a developer bearing member configured to bear the developer for applying the toner to the image bearing member; and a discharge portion configured to discharge the developer from the container in a case where the developer contained in the container exceeds a predetermined amount greater than the first amount. The image forming apparatus further includes: a replenishment unit configured to replenish the container with the developer; a permeability sensor configured to output a detection signal correlated with a magnetic permeability of the developer within the container; and a controller configured to control replenishment operation of the replenishment unit depending on the detection signal output from the permeability sensor with reference to a reference signal, and configured to send a control signal to the permeability sensor for adjusting an input-output relationship between the magnetic permeability of the developer in the container and the detection signal output from the permeability sensor. The controller is configured to use, in a state where a second amount of the developer which is greater than the first amount of the developer is contained in the container, a value of the control signal different from a value of the control signal that is used in a state where the first amount of the developer is contained in the container.

According to another aspect of the present invention, an image forming apparatus includes: an image bearing member configured to bear an electrostatic latent image formed thereon; and a developing unit configured to develop the electrostatic latent image formed on the image bearing member. The developing unit includes: a container configured to contain developer including nonmagnetic toner and magnetic carrier, a first amount of the developer being sealed in the container in an initial state where the developing unit is not yet used; a developer bearing member configured to bear the developer for applying the toner to the image bearing member; and a discharge portion configured to discharge the developer from the container in a state where the developer contained in the container exceeds a predetermined amount greater than the first amount. The image forming apparatus further includes: a replenishment unit configured to replenish the container with the developer; a permeability sensor configured to output a detection signal correlated with a magnetic permeability of the developer within the container; and a controller configured to control replenishment operation of the replenishment unit depending on the detection signal output from the permeability sensor with reference to a reference signal. The controller is configured to use, in a state where the first amount of the developer is contained in the container, a value of the reference signal different from a value of the reference signal that is used in a state where a second amount of the developer which is greater than the first amount of the developer is contained in the container.

Further features of the present invention will become apparent from the following description of exemplary embodiments with reference to the attached drawings.

DESCRIPTION OF THE EMBODIMENTS

Exemplary embodiments of the invention will be described below with reference to the attached drawings

First Embodiment

A first embodiment will be described. At first, a general configuration of an image forming apparatus according to the present embodiment will be described with reference to FIGS. 1 and 2.

Image Forming Apparatus

An image forming apparatus 100 according to the present embodiment is a tandem-type full-color image forming apparatus adopting an electrophotographic system. The image forming apparatus 100 includes image forming portions PY, PM, PC and PK which respectively form images of yellow, magenta, cyan and black. The image forming apparatus 100 is capable of forming a full-color image on a recording media based on image signals transmitted from a document reader (not shown) connected to an apparatus body 100A or an external device such as a personal computer connected in a communicable manner to the apparatus body 100A. Sheet materials such as paper sheets, plastic films and cloth are examples of the recording media.

The four image forming portions PY through PK in the image forming apparatus 100 have similar configurations, except for the difference in color of developed images. The image forming portion PK for forming black image is described below as an example, and the descriptions of other image forming portions PY, PM and PC will be omitted.

Figure 2:
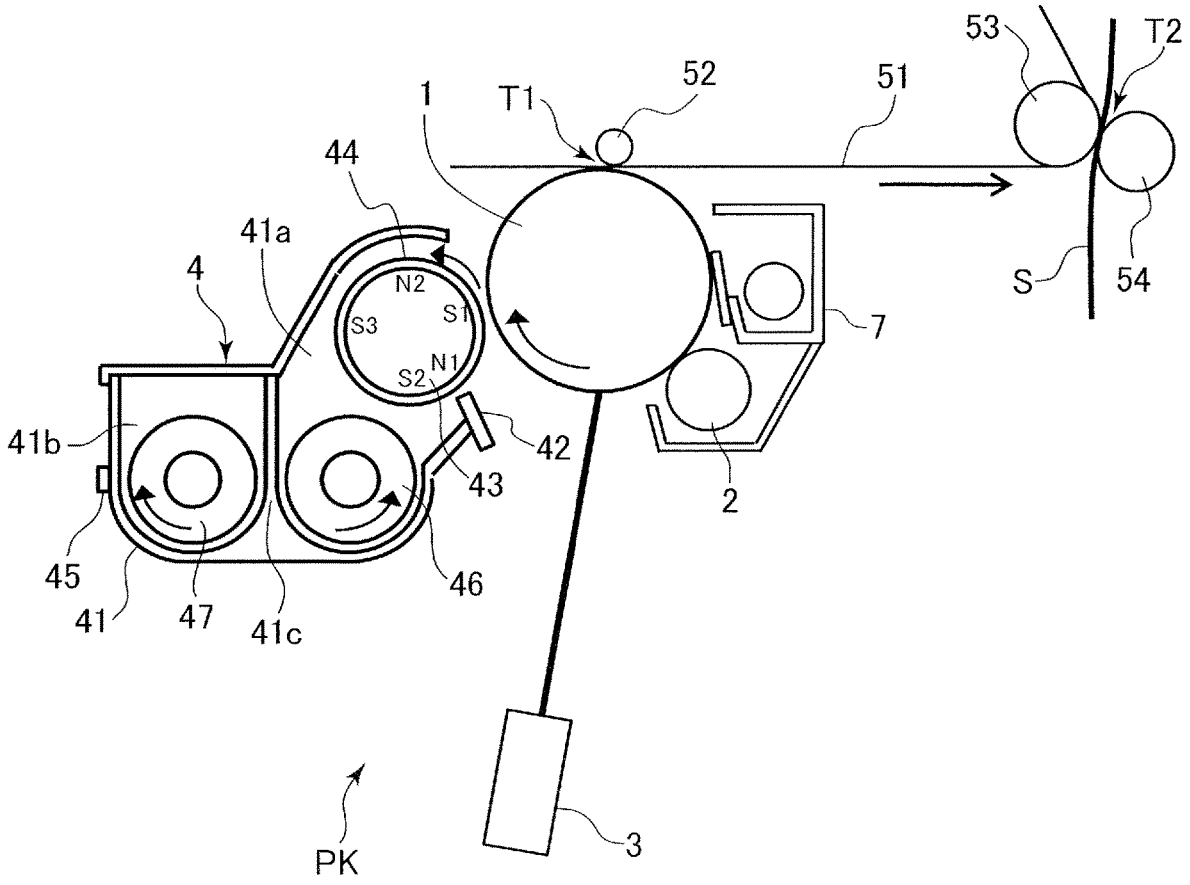
FIG. 2 is a schematic drawing illustrating a configuration of an image forming portion.

A photosensitive drum 1 serving as an image bearing member is rotatably provided on the image forming portion PK, as illustrated in FIG. 2. The photosensitive drum 1 is driven to rotate in the direction of the arrow in the drawing. A charging unit 2, an exposing unit 3, i.e., laser scanner, a developing unit 4, a primary transfer roller 52 and a cleaning unit 7 are arranged around the photosensitive drum 1.

An intermediate transfer device 5 is arranged above the respective image forming portions. The intermediate transfer device 5 is configured such that an endless intermediate transfer belt 51 is stretched across a plurality of rollers and moves in the direction of the arrow. The intermediate transfer belt 51 can move bearing a toner image primarily transferred thereto as described later. A secondary transfer outer roller 54 is arranged at a position opposed to a secondary transfer inner roller 53 on which the intermediate transfer belt 51 is stretched, and having the intermediate transfer belt 51 intervened, as illustrated in FIG. 2. The secondary transfer inner roller 53 and the secondary transfer outer roller 54 form a secondary transfer portion T2 where the toner image on the intermediate transfer belt 51 is secondarily transferred to the recording media.

A cassette 9 storing recording media is arranged at a lower portion of the image forming apparatus 100. The recording media fed from the cassette 9 is conveyed via a conveyance roller 91 to a registration roller 92. Skewing of the recording media is corrected by having a leading edge of the recording media abut against the registration roller 92 in a stopped state and forming a loop. Thereafter, the registration roller 92 is rotated in synchronization with the toner image on the intermediate transfer belt 51, and the recording media is conveyed to the secondary transfer portion T2.

A process for forming a full color image by the image forming apparatus 100 described above will be described. At first, the surface of the photosensitive drum 1 rotated at a matched timing with the start of the image forming operation is charged uniformly by the charging unit 2. Next, the photosensitive drum 1 is scanned and exposed by a laser beam, corresponding to an image signal, emitted from the exposing unit 3. Thereby, an electrostatic latent image corresponding to the image signal is formed on the photosensitive drum 1 serving as an image bearing member. The electrostatic latent image on the photosensitive drum 1 is developed into a toner image by applying two-component developer (more specifically, by toner) stored in the developing unit 4. In the present embodiment, the developing unit 4 is a replaceable unit attached to the apparatus body 100A. In the new developing unit 4 (i.e., in an initial state where the developing unit is not yet used), a two-component developer of a predetermined amount (initial amount) of developer, is sealed in advance. In the present embodiment, the amount of developer enclosed in advance in the developing unit 4 is approximately 120 g, for example.

The toner image formed on the photosensitive drum 1 is primarily transferred to the intermediate transfer belt 51 at a primary transfer portion T1 formed between the photosensitive drum 1 and the primary transfer roller 52 with the intermediate transfer belt 51 intervened. In this state, primary transfer bias is applied to the primary transfer roller 52.

Toner remaining on the photosensitive drum 1 after primary transfer is removed by the cleaning unit 7.

This kind of operation is performed sequentially in the respective image forming portions PY through PK of yellow, magenta, cyan and black, and the toner images of four colors are superposed on the intermediate transfer belt 51. Meanwhile, the recording media stored in the cassette 9 is conveyed to the secondary transfer portion T2 at a matched timing with the formation of toner image. Then, by applying secondary transfer bias to the secondary transfer outer roller 54, the four-color toner image on the intermediate transfer belt 51 is collectively secondarily transferred to the recording media. Toner remaining on the intermediate transfer belt 51 after image has been transferred at the secondary transfer portion T2 is removed by an intermediate transfer belt cleaner 55.

The recording media on which the toner image has been secondarily transferred is conveyed to a fixing unit 6. The fixing unit 6 includes a fixing roller 61 and a pressure roller 62, and the fixing roller 61 together with the pressure roller 62 form a fixing nip portion. It is noted that the fixing roller 61 may be replaced with a film or a belt, and the pressure roller 62 may be replaced with a belt. The recording media is heated and pressed when passing through the fixing nip portion. Thereby, toner on the recording media is melted and mixed, and then fixed on the recording media as a full-color image. Thereafter, the recording media is discharged by a sheet discharge roller 10 onto a discharge tray 11. Thereby, the sequence of image forming processes is completed.

Developing Unit

Next, the developing unit 4 will be described with reference to FIGS. 2 and 3. The developing unit 4 includes a container 41 containing a two-component developer, hereinafter simply referred to as developer, including nonmagnetic toner and magnetic carrier. That is, the present embodiment adopts a two-component developing system as the developing system, where nonmagnetic toner having negative polarity and magnetic carrier having positive polarity are mixed and used as developer. One example of nonmagnetic toner is produced by making coloring agent and wax component mixed into resin such as polyester or styrene acryl, powdering the resin by pulverization or polymerization, then adding fine powder of titanium oxide, silica or the like to a surface thereof. One example of magnetic carrier is produced by applying resin coating on a surface of cores of ferrite particles or resin particles kneaded with magnetic powder.

The container 41 has an opening portion as a developing area opposed to the photosensitive drum 1, and a developing sleeve 44 is rotatably disposed in the opening portion to be partially exposed. A magnet roll 43 having a plurality of magnetic poles along a circumferential direction and not rotatable is disposed inside the developing sleeve 44. The developing sleeve 44 is formed of a nonmagnetic material, which rotates in the direction of the arrow in FIG. 2 during image forming operation to bear and convey developer to the developing area. For example, the photosensitive drum 1 is rotated at a rotation speed, i.e., processing speed, of 300 mm/sec, and the developing sleeve 44 is rotated at a rotation speed of 450 mm/sec.

A developing chamber 41*a* serving as a first chamber and an agitating chamber 41*b* serving as a second chamber which can store developer are formed in the container 41. The developing chamber 41*a* together with the agitating chamber 41*b* constitutes a circulation path through which developer is circulated. The interior of the container 41 is separated by a partition 41*c* into the developing chamber 41*a* and the agitating chamber 41*b*, such that the developing chamber 41*a* and the agitating chamber 41*b* are communicated at both ends in the longitudinal direction of the container 41, that is, on right and left sides in FIG. 3, through communication ports 41*f* and 41*g*.

A developing screw 46 and an agitating screw 47 are respectively provided in the developing chamber 41*a* and the agitating chamber 41*b*. In further detail, the developing screw 46 is provided in the developing chamber 41*a* and the agitating screw 47 is provided in the agitating chamber 41*b*. The developing screw 46 and the agitating screw 47 are screws having a helical blade or fin disposed around the rotation shaft, and the screws are capable of agitating and conveying developer. In the present embodiment, the developer in the developing chamber 41*a* is agitated and moved toward the left side of FIG. 3 by the developing screw 46, and it is transferred from the developing chamber 41*a* through the communication port 41*f* to the agitating chamber 41*b*. Meanwhile, the developer in the agitating chamber 41*b* is agitated and moved toward the right side of FIG. 3 by the agitating screw 47, and it is transferred from the agitating chamber 41*b* to the developing chamber 41*a* through the communication port 41*g*. As described, the developer is conveyed to circulate in the container 41 while being agitated by the developing screw 46 and the agitating screw 47. In the present embodiment, in order to enhance the agitating performance of developer, ribs that protrude radially from the rotation shaft are formed on the agitating screw 47. Further, the developing sleeve 44, the developing screw 46 and the agitating screw 47 are driven to rotate by a developing motor 40 via a gear member not shown. The developing motor 40 is controlled by a control unit 110 described later (refer to FIG. 7).

The developer in the developing chamber 41*a* can be applied to the developing sleeve 44 while being conveyed by the developing screw 46. A predetermined quantity of developer supplied to the developing sleeve 44 is borne on the developing sleeve 44 by magnetic field that is generated by the magnet roll 43 and forms a developer accumulation. By rotation of the developing sleeve 44, the developer attached on the developing sleeve 44 passes the developer accumulation where the layer thickness thereof is regulated by a blade 42, and thereafter, conveyed to the developing area opposed to the photosensitive drum 1. In the developing area, the developer on the developing sleeve 44 rises up and forms a magnetic brush. Then, the magnetic brush is made to contact the photosensitive drum 1 and apply toner of the developer to the photosensitive drum 1, by which the electrostatic latent image formed on the photosensitive drum 1 is developed as toner image. Further, in order to enhance the developing efficiency, that is, application rate of toner to the electrostatic latent image, normally, a developing bias having superposed DC voltage and AC voltage is applied to the developing sleeve 44. The developer on the developing sleeve 44 after having applied toner to the photosensitive drum 1 is returned to the developing chamber 41*a* by further rotation of the developing sleeve 44. Toner is consumed by such developing process, and developer having lower toner density is transferred from the developing chamber 41*a* to the agitating chamber 41*b*. Toner density of developer in a new developing unit 4 in which the initial amount of developer is contained is, for example, 8%.

ACR Control

In the case of the developing unit 4 where image is developed using a two-component developer, in addition to consumption of toner accompanying the development of toner images, carrier deterioration occurs where charging performance to toner is deteriorated. When carrier deterioration proceeds, image defects such as density fluctuation and/or fogging caused by toner scattering tend to occur. Therefore, along with the replenishment of toner, ACR (Auto Carrier Refresh) control is carried out where carrier is replaced and refreshed. During ACR control as replenishment control, replenishing developer in which toner and carrier are mixed at a weight ratio of 9:1, for example, is replenished from a replenishment unit 8.

Figure 3:
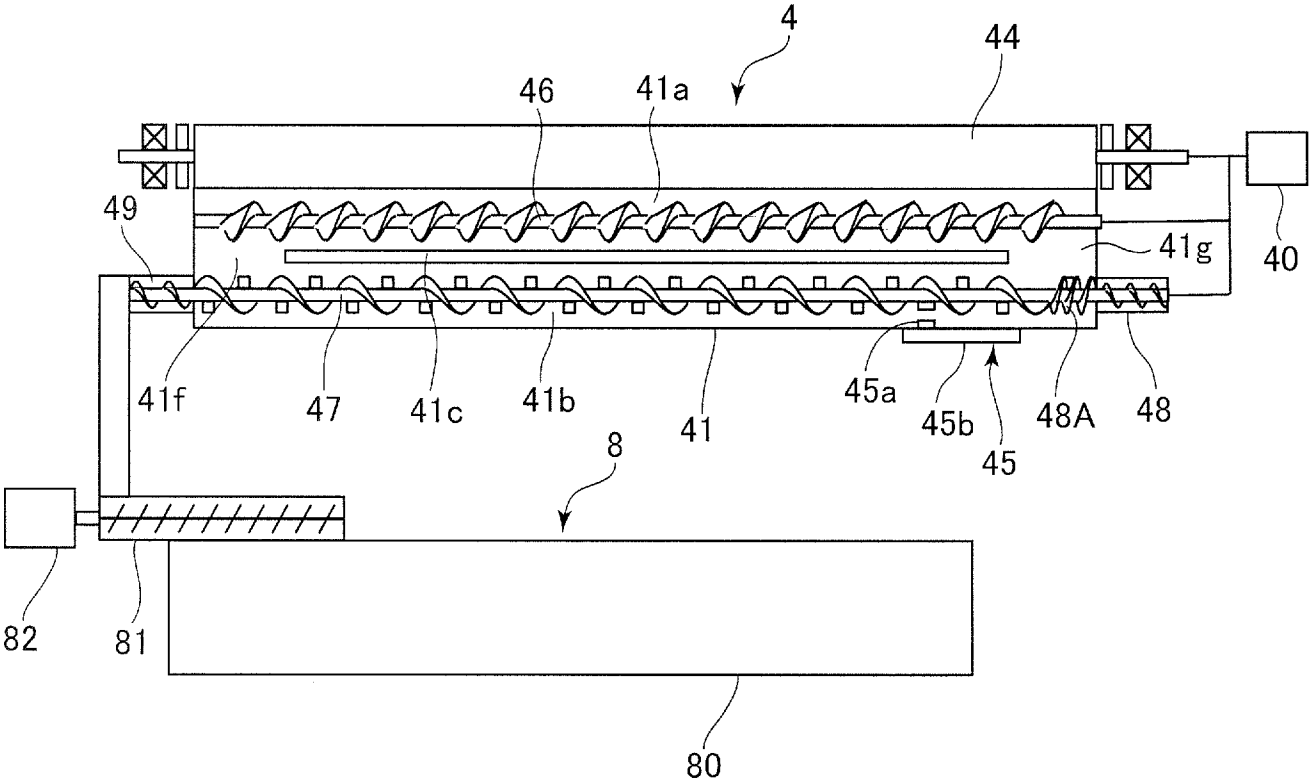
FIG. 3 is a top view illustrating a developing unit in a horizontal cross-section extending along an axial direction.

As illustrated in FIG. 3, a discharge portion 48 for discharging a portion of the developer contained in the developing unit 4 (more specifically, contained in the container 41, the same applies hereafter) as excessive developer is provided on a downstream side in the conveyance direction of the agitating screw 47 in the agitating chamber 41*b*. Further, a return screw 48A that functions as a regulation member that regulates entry of developer to the discharge portion 48 by conveying the developer in an opposite direction than the conveyance direction of the agitating screw 47 is provided on a downstream side of the agitating screw 47 and an upstream side of the discharge portion 48 (that is, on a downstream part of the agitating chamber 41*b*). Thereby, developer that is conveyed in the agitating chamber 41*b* and that flows over the return screw 48A is discharged through the discharge portion 48 to the exterior of the container 41. Developer discharged through the discharge portion 48 is collected in a collecting container not shown. In the present embodiment, developer will be discharged from the discharge portion 48 when the amount of developer in the developing unit 4 is equal to or greater than 150 g.

Meanwhile, a replenishing portion 49 that receives replenishing developer from the replenishment unit 8 is provided on an upstream side in the conveyance direction of the agitating screw 47 in the agitating chamber 41*b*. Each replenishment unit 8 (refer to FIG. 1) is arranged above the developing unit 4 of each of the image forming portions PY through PK, and replenishes the replenishing developer to the developing unit 4 of each of the image forming portions PY through PK. As illustrated in FIG. 3, the replenishment unit 8 includes a replenishing container 80 storing replenishing developer, a replenishing screw 81 configured to convey replenishing developer in the replenishing container 80, and a replenishing motor 82 configured to rotate the replenishing screw 81.

In response to a detection signal (more specifically, toner density of developer based on the detection signal) of a permeability sensor 45 described later, the control unit 110 (refer to FIG. 7) controls the replenishing motor 82. In the present embodiment, a block replenishment system is adopted as a method for replenishing the replenishing developer by the replenishment unit 8. A block replenishment system refers to a system in which replenishing developer is replenished in a predetermined unit of an amount set in advance corresponding to one rotation of the replenishing screw 81, i.e., block replenishment amount, by controlling the replenishing screw 81, instead of replenishing an arbitrary amount of replenishing developer at all times. In the present embodiment, the amount of replenishment of replenishing developer is adjusted by controlling the period of rotation of the replenishing motor 82 by the control unit 110.

In the agitating chamber 41*b*, the replenishing developer replenished to the agitating chamber 41*b* is agitated while being conveyed by the agitating screw 47 together with the developer transferred from the developing chamber 41*a*. Excessive developer that has become excessive by replenishment of the replenishing developer is discharged to the exterior of the container 41 through the discharge portion 48. With this operation, deteriorated carrier is discharged, depending on the amount of developer in the developing unit 4. As described, by having replenishing developer replenished from the replenishment unit 8, toner consumed by development is replenished and carrier is replaced.

The above-described ACR control is executed by the control unit 110 described later. The control unit 110 can compute an appropriate amount of replenishment of toner by computing an amount of toner consumption for each sheet of recording media based on density and area of image being formed, and the toner density of developer detected using the permeability sensor 45.

Permeability Sensor

In the present embodiment, the permeability sensor 45 is used to detect the toner density of developer stored in the container 41. The use of the permeability sensor 45 enables to perform ACR control at any time even while forming images, so that effective operation of the image forming apparatus 100 may be realized.

As illustrated in FIG. 3, the permeability sensor 45 has a probe head 45*a* capable of detecting magnetic permeability of the developer exposed in the agitating chamber 41*b*, opposing a portion of the agitating screw 47. As mentioned above, developer is mainly composed of nonmagnetic toner and magnetic carrier. If the toner density of developer, that is, ratio of toner weight with respect to the total weight of toner and carrier, is varied, the permeability according to the mixture ratio of magnetic carrier and nonmagnetic toner is also varied. Therefore, detecting changes in permeability is detected by the permeability sensor 45, the toner density of the developer can be measured.

The permeability sensor 45 according to the present embodiment uses inductance of coil to generate a detection signal correlated with permeability of developer as a variable to be measured. In the permeability sensor 45, the probe head 45*a* with a cylindrical shape is formed on a plate-like base plate portion 45*b* and is arranged to protrude from the base plate portion 45*b*. Coils not shown (including a driving coil, a detecting coil and a reference coil) that generate magnetic field when energized are arranged in the probe head 45*a*. Meanwhile, although not shown, electronic components other than coils, such as a capacitor, a semiconductor integrated circuit (IC), a resistance and so on, are arranged on the base plate portion 45*b*, and these electronic components are electrically connected to the coils on the probe head 45*a*.

That is, the permeability sensor 45 of the present embodiment is a sensor that adopts the principle of a differential transformer using electromagnetic induction. The differential transformer is formed by providing a driving coil, a reference coil and a detecting coil in one core. When a high-frequency (such as 500 kHz) AC voltage is input as control signal (Vin), the permeability sensor 45 emits differential output of detection signal (Vout), which can be denoted as "Vout=V2−V3". Here, peak voltage value of the reference coil is represented by "V2" and peak voltage value of the detecting coil is represented by "V3". For example, according to the toner density of developer sealed in the non-used, initial state (which is 8%, for example), it is assumed that the peak voltage values of the detecting coil and the reference coil are "V30" and "V20" respectively in a state where a predetermined control signal is applied. In that case, (by adjusting a ratio of number of turns of the detecting coil and the reference coil, for example) a circuit configuration of V30=V20 can be realized in a state where the toner density is set to the initial value. In this case, defining voltage variation of the detecting coil at an arbitrary toner density as "ΔV3", a peak voltage value of "Vout=V2−V3=V20−(V30+ΔV3)=−ΔV3" will be output from the permeability sensor 45 in a differential manner as the detection signal.

In the above description, "control signal" of the permeability sensor refers to an arbitrary signal capable of adjusting the level of the detection signal with respect to the permeability of developer near the probe head 45*a*, i.e., an input-output relationship between the magnetic permeability of developer and the detection signal. In the present embodiment, it is assumed that drive voltage itself for exciting the driving coil is the control signal, and the amplitude thereof is represented by Vin. Instead of the above-described configuration, it is also possible to fix the drive voltage of the driving coil and amplify the output of the differential transformer (ΔV3) to obtain detection signal (Vout) so that the signal designating the amplification ratio is used as control signal. In that case, a configuration can be adopted where a signal line connected to the control unit is provided to the permeability sensor 45 independently of a power line through which power for activating the driving coil is supplied, and where DC voltage as control signal is entered to the signal line.

Figure 4:
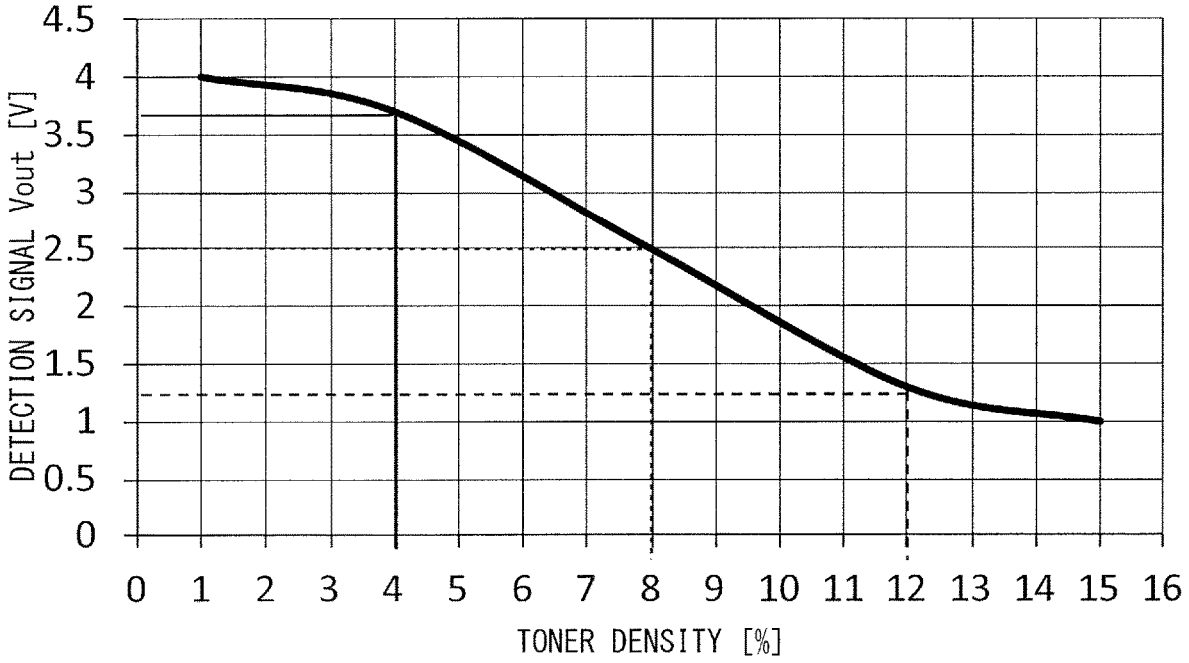
FIG. 4 is a graph illustrating a relationship between toner density of developer and a detection signal of a permeability sensor.

FIG. 4 illustrates a relationship between toner density of developer and detection signal (Vout) of the permeability sensor 45. As can be seen from FIG. 4, the lower the toner density of developer is, the higher the detection signal of the permeability sensor 45 is. This is because the ratio of magnetic carrier contained in the developer per unit volume becomes high and an apparent permeability of developer becomes also high. In contrast, the higher the toner density of developer is, the lower the detection signal of the permeability sensor 45 is, because the ratio of magnetic carrier contained in the developer per unit volume becomes low and the apparent permeability of developer also becomes low.

According to the present embodiment, adjustment is performed in advance so that the peak value of detection signal of the permeability sensor 45 is "2.5 V" in a case where the toner density of the initial amount of developer is 8%, which is referred to as a reference signal. Also, adjustment is performed such that the detection signal varies approximately linearly with respect to the toner density in a case where the toner density is 4% or higher and 12% or lower (more preferably, within a range of 6% or higher and 9% or lower). Conversion of toner density based on the detection signal of the permeability sensor 45 can be performed, for example, by the control unit 110 (refer to FIG. 7) referring to a table defining the relationship illustrated in FIG. 4 or computing an approximation representing the relationship illustrated in FIG. 4.

By the way, according to the permeability sensor 45 described above, the detection signal, more specifically, the peak voltage value, can be varied even if the toner density is the same, depending on the level of control signal (Vin) entered to activate the permeability sensor 45. As the control signal, voltage that supplies current having a predetermined waveform is applied from a power supply 450 to the permeability sensor 45 (refer to FIG. 7). It is noted that in the modified example where the power line and the signal line of the permeability sensor 45 are separated as explained above, the control signal is entered from the control unit 110, so the power supply 450 should merely function to supply power to the permeability sensor 45. In that case, it is possible to provide an oscillation circuit for supplying AC to the driving coil in the permeability sensor 45, and supply DC of a constant voltage from the power supply 450 to the permeability sensor 45 to activate the oscillation circuit.

Figure 5:
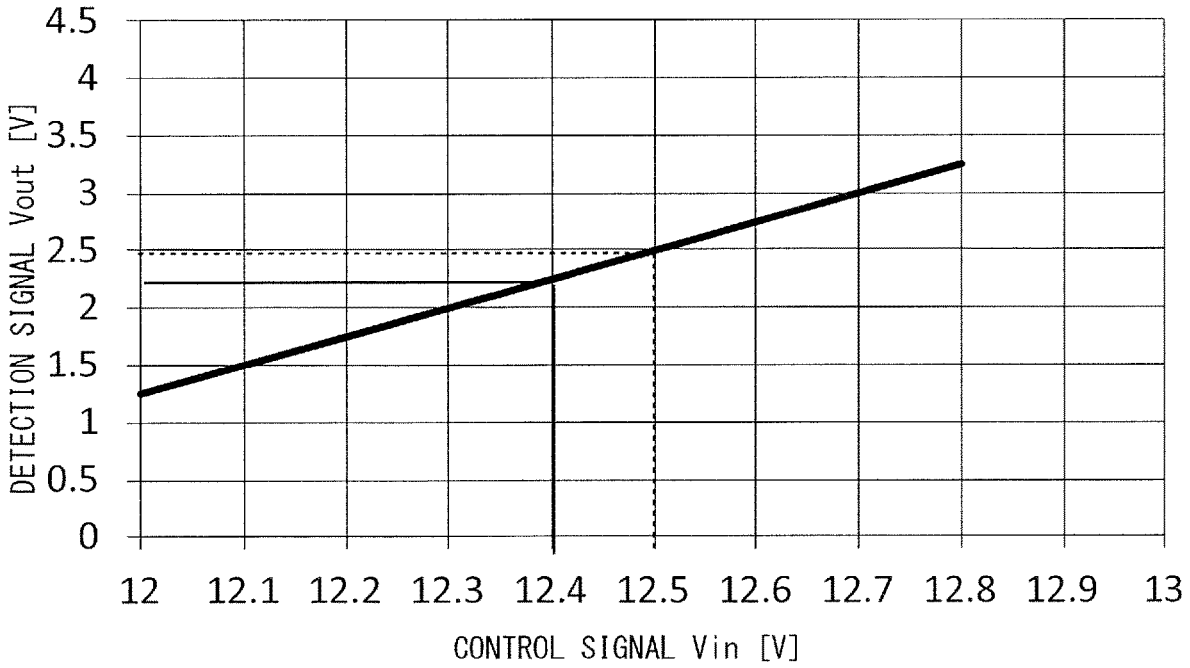
FIG. 5 is a graph illustrating a relationship between a control signal and the detection signal of the permeability sensor.

FIG. 5 illustrates a relationship between control signal of the permeability sensor 45 and detection signal of the permeability sensor 45. As can be recognized from FIG. 5, even if the toner density is the same, the detection signal output from the permeability sensor 45 according to the present embodiment can be shifted within the sensor output range by adjusting the control signal. For example, even if the toner density of developer is 8% and not changed, the detection signal will be "2.5 V" in a case where the control signal is "12.5 V" and will be "2.75 V" in a case where the control signal is "12.6 V". As described, a greater detection signal can be acquired by increasing the control signal compared to a case where the control signal is not increased. The adjustment of the control signal is performed by the control unit 110 described later (refer to FIG. 7).

Figure 6:
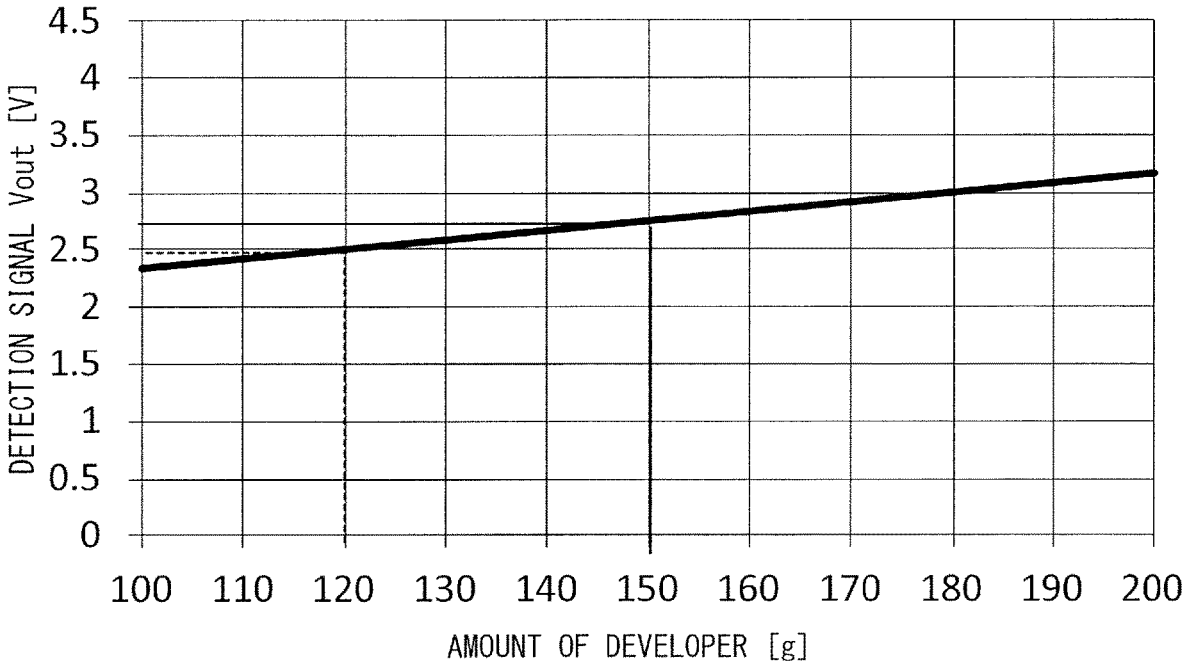
FIG. 6 is a graph illustrating a relationship between an amount of developer in a developing unit and the detection signal of the permeability sensor.

According further to the permeability sensor 45 described above, even if the control signal and the toner density of developer are not varied, the detection signal may be changed if a bulk density of developer is varied. The bulk density of developer varies according to the amount of developer in the developing unit 4. FIG. 6 illustrates the relationship between the amount of developer in the developing unit 4 and the detection signal of the permeability sensor 45. As illustrated in FIG. 6, the detection signal of the permeability sensor 45 becomes high as the amount of developer in the developing unit 4 increases. That is, if the amount of developer in the developing unit 4 increases and the bulk density of developer increases, the density of magnetic carrier contained in a unit volume of developer becomes high and apparent permeability of developer becomes high, so that the detection signal becomes high. In contrast, if the amount of developer in the developing unit 4 decreases and the bulk density of developer decreases, the density of magnetic carrier contained in a unit volume of developer becomes low and apparent permeability of developer becomes low, so that the detection signal becomes low.

Control Unit

Figure 1:
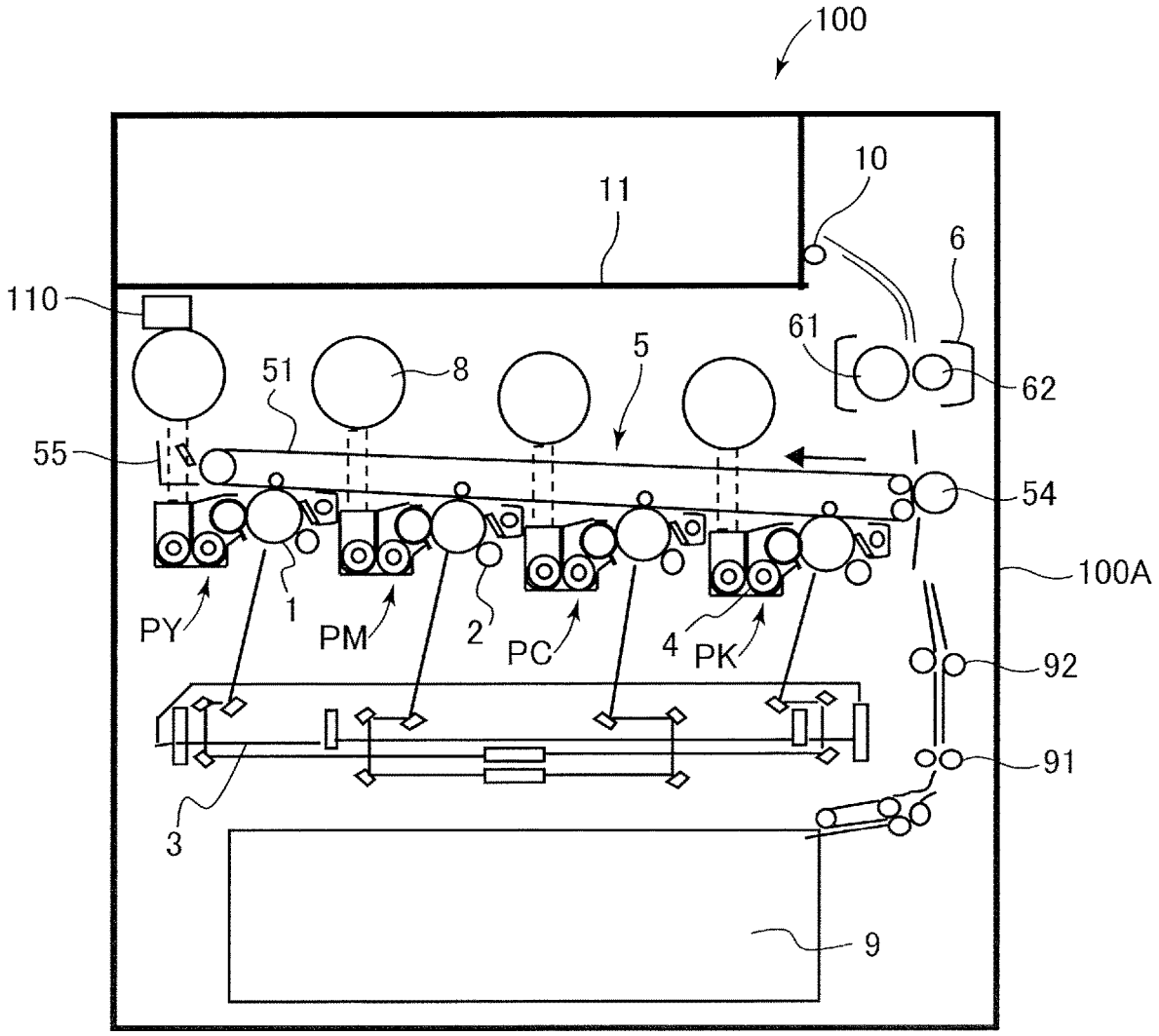
FIG. 1 is a schematic drawing illustrating a configuration of an image forming apparatus according to the present disclosure.

As illustrated in FIG. 1, the image forming apparatus 100 includes the control unit 110, and the control unit 110 controls various units described above that constitute the image forming apparatus 100. The control unit 110 will now be described with reference to FIG. 7. The photosensitive drum 1, the charging unit 2, the exposing unit 3, the primary transfer roller 52, the fixing unit 6, the cleaning unit 7, the intermediate transfer belt 51 and so on and motors or power supplies that drive these units are also connected to the control unit 110 in addition to the illustrated configuration, but they are not shown in the drawing and are not described herein.

The control unit 110 according to the present embodiment includes a CPU (Central Processing Unit) 111 and a storage device 112. The storage device 112 includes a ROM (Read Only Memory) 113 and a RAM (Random Access Memory) 114. The ROM 113 stores various programs such as an image forming job and data. The CPU 111 can operate the image forming apparatus 100 by executing the various programs stored in the ROM 113. Further, the RAM 114 stores operation data and input data. The CPU 111 can refer to the data stored in the RAM 114 based on the various programs.

An image forming job is a sequence of operations from the start of forming an image based on an image signal for forming image on a recording media to the completion of the image forming operation. In other words, it is a sequence of operations that starts when a preliminary operation, so-called pre-rotation, that is required for image formation is started, continues during the image forming process and ends when the preliminary operation, so-called post-rotation, that is required to end the image forming process is completed. More specifically, it refers to a period that starts when pre-rotation is started as preparation operation prior to image forming after a printing signal is received, i.e., after an image forming job is entered, and ends after post-rotation as operation performed after image forming is completed, wherein this period includes the image forming period and the interval between sheets.

The developing motor 40, the replenishing motor 82 and the permeability sensor 45 described above are controlled by the control unit 110. In the present embodiment, the control unit 110 controls the drive of the replenishing motor 82 based on the detection signal of the permeability sensor 45, and replenishing developer is replenished by the replenishment unit 8 (refer to FIG. 1). Specifically, the detection signal of the permeability sensor 45 is temporarily stored in the storage device 112 and then transmitted to the CPU 111. Then, the CPU 111 compares the toner density based on the detection signal of the permeability sensor 45 with a target toner density (6 to 9%, for example) stored in the storage device 112. The CPU 111 performs replenishment control (i.e., control of replenishment operation) for replenishment of the replenishing developer based on the comparison result to adjust the toner density of developer in the developing unit 4. The control unit 110 controls the power supply 450 to adjust the control signal entered to the permeability sensor 45 or changes the target toner density stored in the storage device 112 based on the amount of developer in the developing unit 4, so as to appropriately execute replenishment control of the replenishing developer. Detailed description of such adjustment processing is provided later (refer to FIGS. 8 through 15 described later).

Further, a new/used detector 50 for detecting whether the developing unit 4 (refer to FIG. 1) is new or used is connected to the control unit 110. The new/used detector 50 is a fuse, for example, which is provided on the developing unit 4. The new/used detector 50 is in contact with a contact provided on the apparatus body 100A in a state where a new developing unit 4 is attached to the apparatus body 100A. When power is turned on for the first time after the new developing unit 4 is attached to the apparatus body 100A, current flows to the new/used detector 50. The new/used detector 50 is configured to disconnect physically once current flows therethrough, and thereafter, current will not flow therethrough. Then, in the case the developing unit 4 is used, the new/used detector 50 is already disconnected, and current will not flow to the new/used detector 50. Therefore, the control unit 110 can determine that the attached developing unit 4 is not new if current is not flown to the new/used detector 50.

According to the present embodiment, the amount of developer sealed in a new developing unit 4, i.e., first amount, is approximately 120 g. On the other hand, in a case where the amount of developer becomes equal to or greater than 150 g, i.e., predetermined amount, as a result of replenishment of the replenishing developer by the execution of replenishment control, developer will be discharged from the discharge portion 48. In other words, the initial amount of developer filled in advance in the new developing unit 4 is set to 120 g, which is smaller than 150 g where discharge of developer is started. One reason for adopting such configuration is to prevent developer from being discharged meaninglessly when executing an initializing operation of idly rotating the developing screw 46 and the agitating screw 47 immediately after attaching a new developing unit 4 to the apparatus body 100A so that developer is thoroughly supplied in the container 41. For example, in a new developing unit 4, the communication ports 41*f* and 41*g* are sealed by a sealing sticker serving as an example of a sealing member, and developer is enclosed only in the agitating chamber 41*b*. Further, in the new developing unit 4, the opening portion of a discharge portion 48 is also sealed by a sealing member such as a shutter. When the new developing unit 4 is attached to the apparatus body 100A, the sealing realized by the sealing sticker is released either manually or automatically, and a portion of developer enclosed in the agitating chamber 41*b* enters the developing chamber 41*a*. However, developer is not thoroughly supplied across the container 41 in this state, so the developing screw 46 and the agitating screw 47 are rotated idly. In this state, if the initial amount of developer is greater than 120 g, a portion of the developer may go over the return screw 48A and be discharged from the discharge portion 48. If developer is discharged during the initializing operation, non-used developer will be discharged and wasted. Therefore, in order to prevent developer from being discharged wastefully during the initializing operation, the initial amount of developer is set at a relatively low amount to prevent discharge of developer during initializing operation.

According to the present embodiment, developer is discharged from the discharge portion 48 approximately at a point of time when the amount of developer in the developing unit 4 reaches 150 g. But during continuous image formation of solid images, for example, the amount of developer being discharged is small compared to the amount of replenishment of developer being replenished. In that case, the amount of developer in the developing unit 4 may exceed 150 g and reach a maximum of 180 g. This is because the increasing rate of carrier during continuous image formation of solid images is approximately equivalent to the discharging rate of developer when the amount of developer is 180 g. Therefore, the maximum amount of developer in the developing unit 4 is approximately 180 g in the case of the present embodiment.

As described above, in the case of the developing unit 4 adopting the ACR system, the amount of developer in the developing unit 4 may vary by the consumption of toner by image development or replenishment of developer. When the amount of developer is varied, the weight of the developer causes a change in the bulk density of developer, and the detection signal of the permeability sensor 45 may be changed (refer to FIG. 6). If the detection signal of the permeability sensor 45 varies depending on to the amount of developer in the developing unit 4, erroneous detection of toner density may occur. In that case, there is a possibility that replenishment control of replenishing developer performed using detection signals obtained by the permeability sensor 45 may not be executed appropriately.

This situation is described in further detail with reference to FIGS. 4 and 6. As illustrated in FIG. 6, when the amount of developer is 120 g, the detection signal is 2.5 V. When the amount of developer reaches 150 g, the detection signal will be 2.75 V. With reference to FIG. 4, these detection signals correspond to a case where the toner density is 8% and a case where the toner density is 7%, respectively. That is, even if toner density is not changed, the toner density is detected as 8% if the amount of developer is 120 g and is detected as 7% if the amount of developer is 150 g. According to this arrangement, assuming the target toner density is 8%, no replenishing developer will be replenished when the amount of developer is 120 g but replenishing developer will be replenished when the amount of developer is 150 g. In such case, even though the actual toner density is the target toner density (8%, in this example), replenishment control is performed so that developer is replenished, and the actual toner density after replenishment may exceed the target toner density. Then, image defects such as a too-high image density tend to occur.

In consideration of the above problem, the present embodiment enables to obtain substantially the same detection signal (Vout) in cases where the toner density is the same, regardless of fluctuations of the amount of developer. This function is achieved by adjusting the control signal (Vin) entered to the permeability sensor 45, based on the amount of developer in the developing unit 4. In other words, a value of the control signal used in the initial state where a first amount of the developer is contained in the container is different from a value of the control signal used in a state where a second amount of the developer is contained in the container. The second amount is greater than the first amount, and is equal to the predetermined amount where discharge of developer starts, for example. In the present embodiment, the first amount of developer (e.g., 120 g) in the initial state is 80% to the predetermined amount (e.g., 150 g) where discharge of developer is started, but the configuration described later is also effective in a case where the amount of fluctuation is greater, that is, if the first amount is less than 80% of the predetermined amount.

Adjustment Processing

Figure 7:
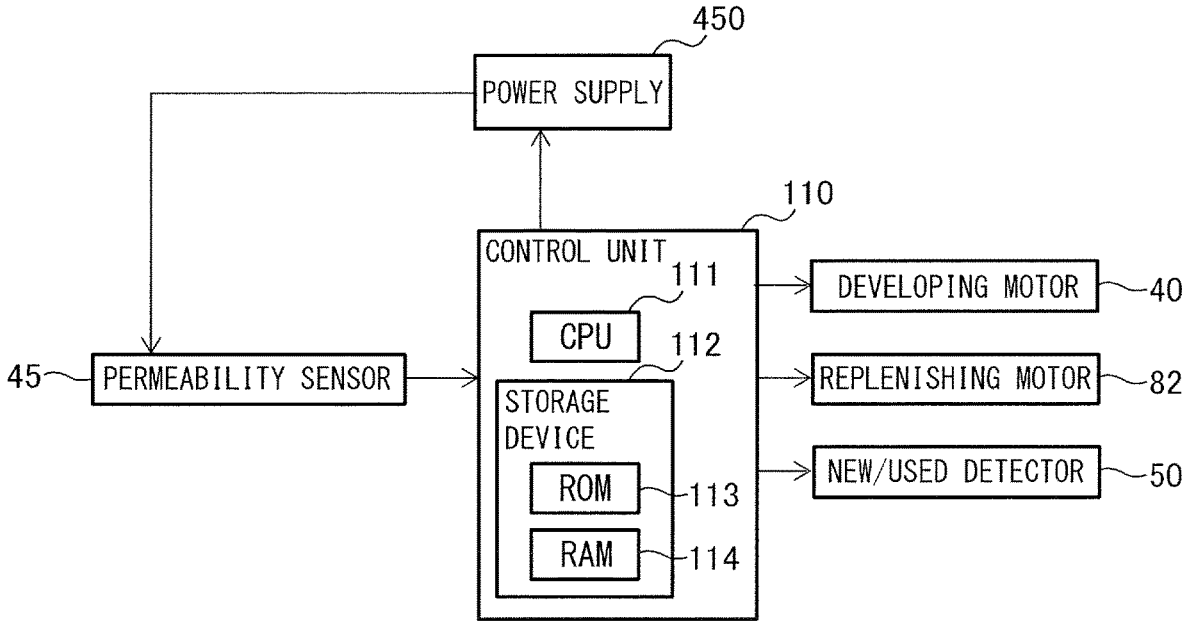
FIG. 7 is a control block diagram illustrating a control unit.
Figure 8:
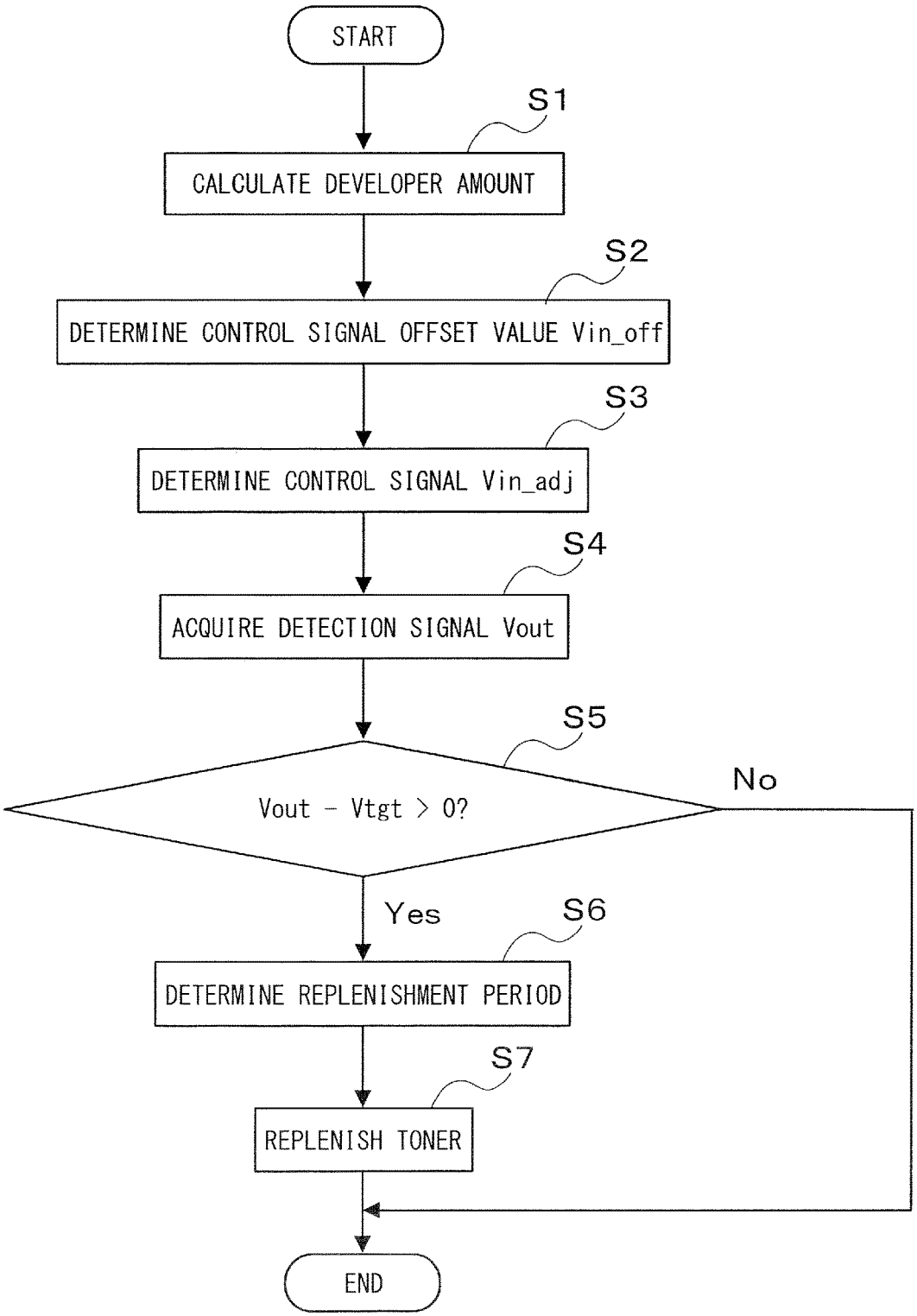
FIG. 8 is a flowchart illustrating an adjustment processing according to a first embodiment.

An adjustment processing of the first embodiment will be described according to FIGS. 8 through 12 with reference to FIGS. 3 and 7. FIG. 8 illustrates an adjustment processing of the first embodiment. The adjustment processing according to the present embodiment is a processing executed by the control unit 110, which is started when an image forming job is started, repeatedly performed and ends when the image forming job is completed. In the adjustment processing of the respective embodiments described below, in order to help understand the embodiment, replenishment control of the replenishment unit 8 is performed together. But the present invention is not restricted thereto, and replenishment control of the replenishment unit 8 may be executed independently. Further, control capable of being executed according to toner density is not restricted to the replenishment control of the replenishment unit 8.

As illustrated in FIG. 8, the control unit 110 computes the amount of developer in the developing unit 4 based on "information regarding amount of developer in developing unit" (S1). In the present embodiment, the amount of developer in the developing unit 4 is obtained by calculating "initial amount of developer + amount of replenishing developer having been replenished by the replenishment unit 8 − amount of toner having been consumed by image development − amount of developer having been discharged through the discharge portion 48".

Figure 9:
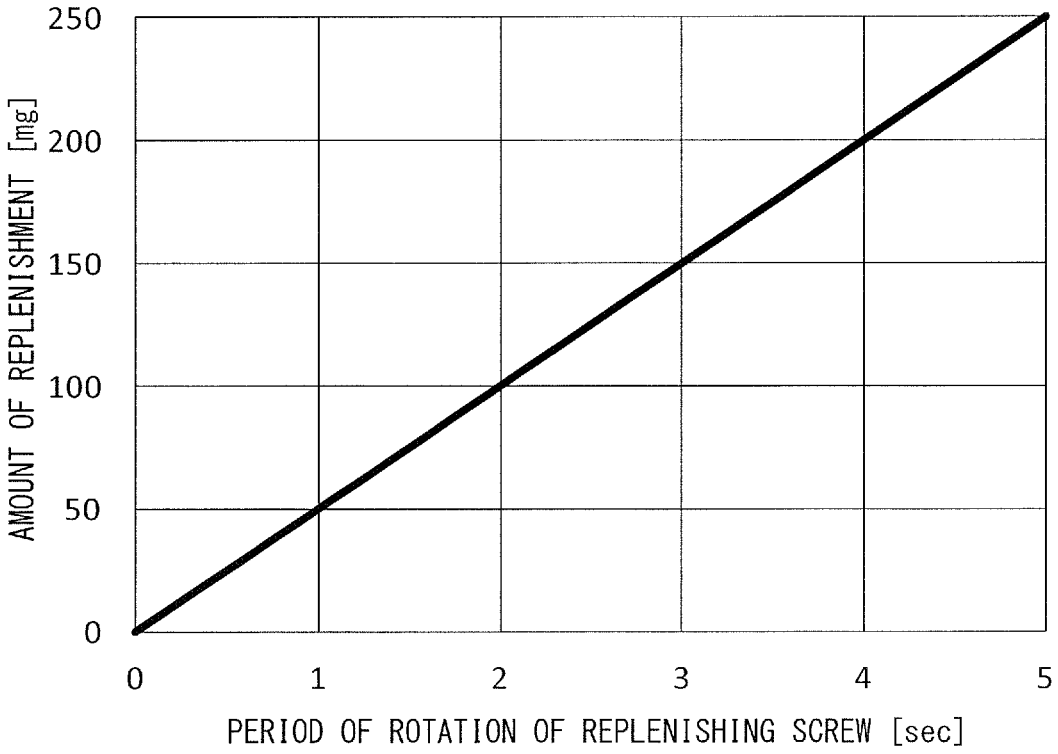
FIG. 9 is a graph illustrating a relationship between period of rotation of a replenishing screw and an amount of replenishment of replenishing developer.

The "initial amount of developer" refers to the amount of developer enclosed in advance in a new developing unit 4. The "amount of replenishing developer having been replenished by the replenishment unit 8" is calculated based on period of rotation of the replenishing screw 81. FIG. 9 illustrates a relationship between the period of rotation of the replenishing screw 81 and amount of replenishment of replenishing developer. As described, the replenishing screw 81 of the replenishment unit 8 is rotated by the replenishing motor 82, in accordance with a block replenishment system in which replenishing developer is replenished by rotating the replenishing screw 81 once for every fixed amount of replenishment set in advance. Therefore, the number of rotations per period of rotation provided, the amount of replenishment of the replenishing developer can be determined. The corresponding relationship between the period of rotation of the replenishing motor 82 and the amount of the replenishing developer being replenished is defined in a table in advance and stored as data in the ROM 113. Based on this data, the control unit 110 can acquire the "amount of replenishing developer having been replenished by the replenishment unit 8" based on the period of rotation of the replenishing screw 81.

The "amount of toner having been consumed by image development" can be computed based on an average image ratio (more specifically, a video count value) of images developed by the developing unit 4. For example, the amount of toner consumed to form an image on one recording media can be computed based on the video count value. During execution of image formation, the video count value can be used to convert into numerical form the amount of toner consumed to form an image on one sheet of recording media S by prescribing the maximum amount of toner used to form an image on the whole area of an A4-size sheet as "1000". Then, the video count value of "1000" can be converted as the amount of toner consumption of approximately 50 mg, for example.

Figure 10:
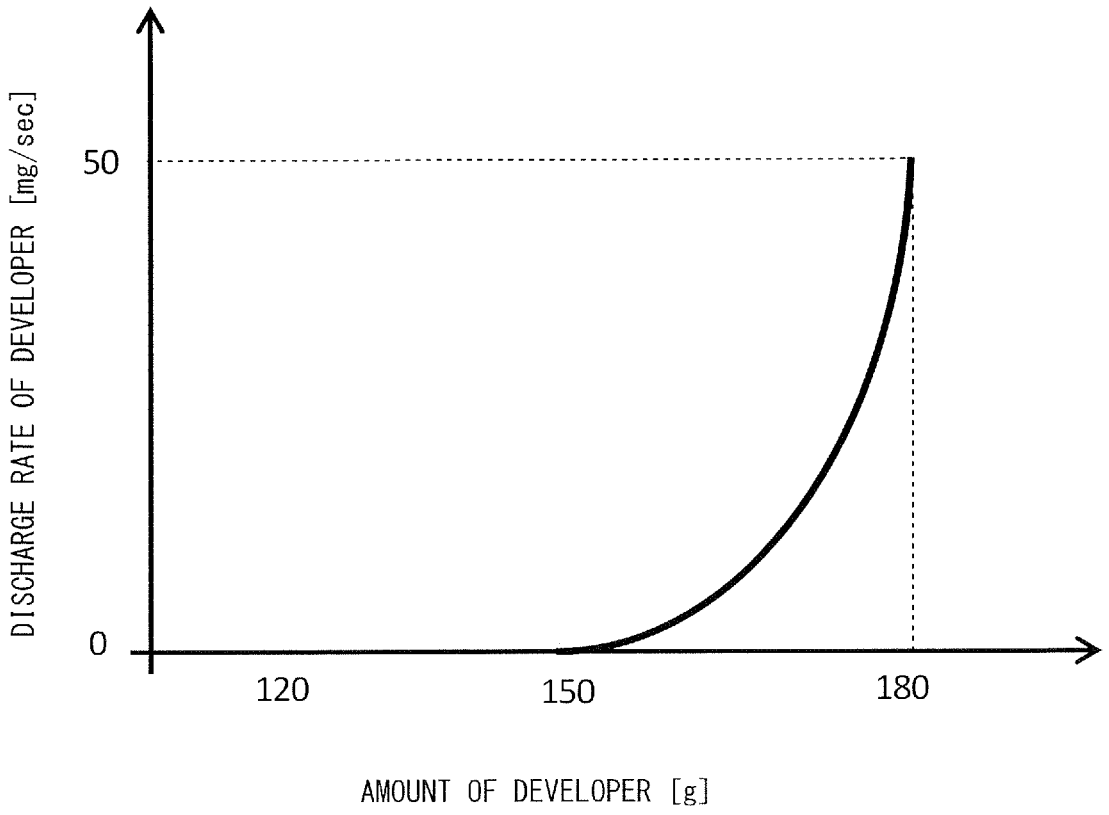
FIG. 10 is a graph illustrating a relationship between amount of developer in the developing unit and discharge rate of developer discharged through a discharge port.

The "amount of developer having been discharged through the discharge portion 48" can be computed based on a table or the like prescribing the relationship between the amount of developer and the discharge rate of developer, as illustrated in FIG. 10, that is stored in advance in the ROM 113 and the like. As illustrated in FIG. 10, when the amount of developer in the developing unit 4 after replenishment of the replenishing developer is 150 g, the "amount of developer having been discharged through the discharge portion 48" will be "0 mg" since the discharge rate of developer is "0 mg/sec". When the amount of developer in the developing unit 4 after replenishment of the replenishing developer is 180 g, the "amount of developer having been discharged through the discharge portion 48" of a case where the period of rotation of the agitating screw 47 is 10 seconds will be "500 mg", since the discharge rate of developer is "50 mg/sec".

Now, a specific example of the amount of developer in the developing unit 4 will be described. Here, it is assumed that the amount of developer in the developing unit 4 at a certain timing is 175 g. Then, it is assumed that image forming job is executed, and during image formation, the developing unit 4 performs image forming operation for ten seconds and the replenishing screw 81 is rotated for five seconds. For sake of simplified description, it is assumed that the amount of replenishment of replenishing developer when the replenishing screw 81 is rotated for five seconds is 5 g. As illustrated in FIG. 10, the amount of developer being discharged in a case where the developing unit 4 performs image forming operation for ten seconds in a case where the amount of developer is 175+5=180 (g) will be 50×10=500 (mg). Therefore, the amount of developer in the developing unit 4 after replenishment will be 180−0.5=179.5 (g).

The "information regarding amount of developer in developing unit" is not restricted to the information obtained from the above-described set of information of the initial amount of developer, the amount of replenishing developer having been replenished, the amount of developer having been discharged, and the amount of toner having been consumed by image development. For example, the "information regarding amount of developer in developing unit" may be a result of detection obtained by a weight detection sensor provided in addition to detect weight of the developing unit 4.

Figure 11:
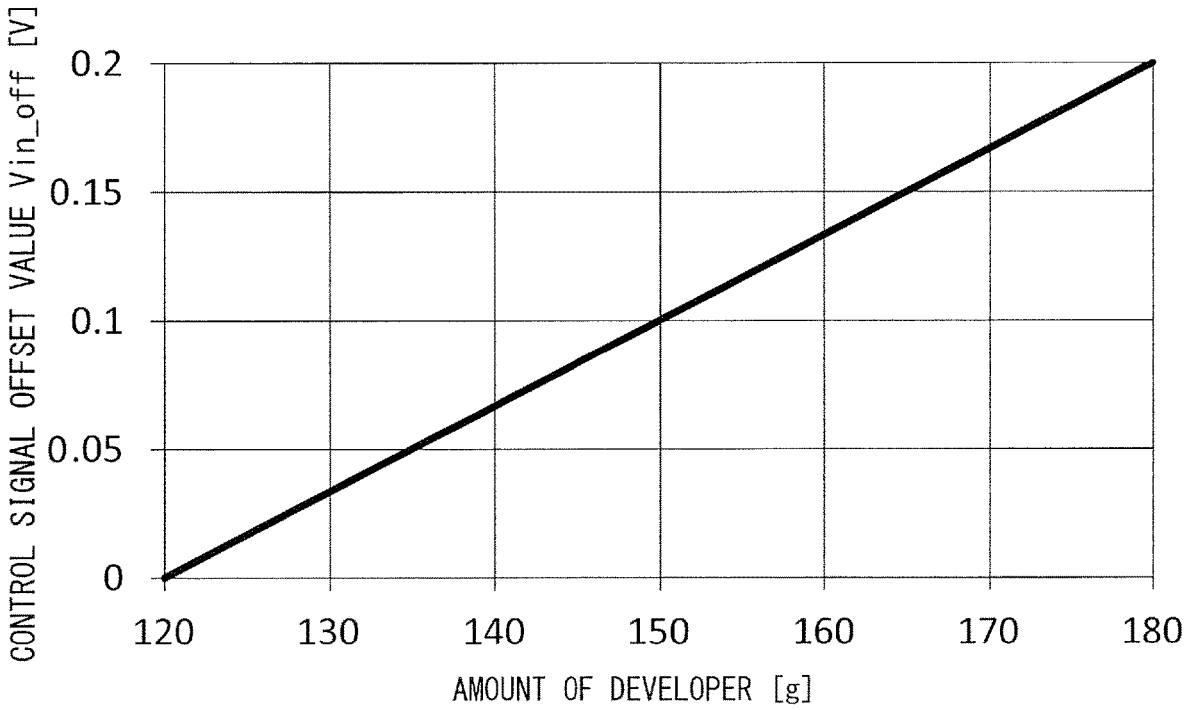
FIG. 11 is a graph illustrating a relationship between the amount of developer in the developing unit and an offset value of the control signal.

Returning to FIG. 8, the control unit 110 determines a control signal offset value (Vin_off) based on the amount of developer in the developing unit 4 (S2). The control signal offset value is determined based on a table and the like, which defines the relationship between the amount of developer and the control signal offset value, stored in advance in the ROM 113 and the like. FIG. 11 illustrates the relationship between the amount of developer and the control signal offset value. Assuming that a control signal before adjustment is "Vin" and the control signal offset value determined based on the amount of developer is "Vin_off", the control unit 110 determines the control signal after adjustment "Vin_adj" (i.e., input value) by the following expression 1 (S3). The control signal before adjustment is set as a signal in a state where the developing unit 4 is new, which is 12.5 V, for example.

$$Vin_adj = Vin - Vin_off \quad \text{Expression 1}$$

As illustrated in FIG. 11, when the amount of developer is 150 g, the control unit 110 determines the control signal offset value as "0.1". In that case, the control signal after adjustment (Vin_adj) will be "12.4 V". When the amount of developer is 180 g, the control unit 110 determines the control signal offset value as "0.2", so that the control signal after adjustment will be "12.3 V". As described, according to the control unit 110, the offset value (or, an adjustment value) for changing the value of the control signal in a case where the amount of developer is 180 g (i.e., second agent quantity), which is greater than 150 g, is greater than the offset value in a case where the amount of developer is 150 g (i.e., first agent quantity), and the control signal is changed accordingly.

The control unit 110 sends the control signal after adjustment (Vin_adj) to the permeability sensor 45, acquires the detection signal (Vout) acquired in response from the permeability sensor 45 (S4), and compares the same with the reference signal (Vtgt, for example, of 2.5 V) (S5). If the difference between the detection signal and the reference signal is 0 or smaller (S5: No), the control unit 110 ends the present processing without executing the replenishment control by the replenishment unit 8. On the other hand, if the difference between detection signal and reference signal is greater than 0 (S5: Yes), the control unit 110 executes replenishment control of the replenishing developer by the replenishment unit 8 (S6 and S7). Specifically, the control unit 110 determines a replenishment period based on the difference between detection signal and reference signal (S6) and rotates the replenishing screw 81 during the determined replenishment period to replenish the replenishing developer (S7).

It is noted that even if the image forming job is completed, information regarding the amount of replenishing developer having been replenished, the amount of developer having been discharged and the amount of toner having been consumed will not be reset, and the amounts are accumulated and stored in the storage device including the ROM 113. The information is utilized to determine the amount of developer in the subsequent adjustment processing.

Figure 12:
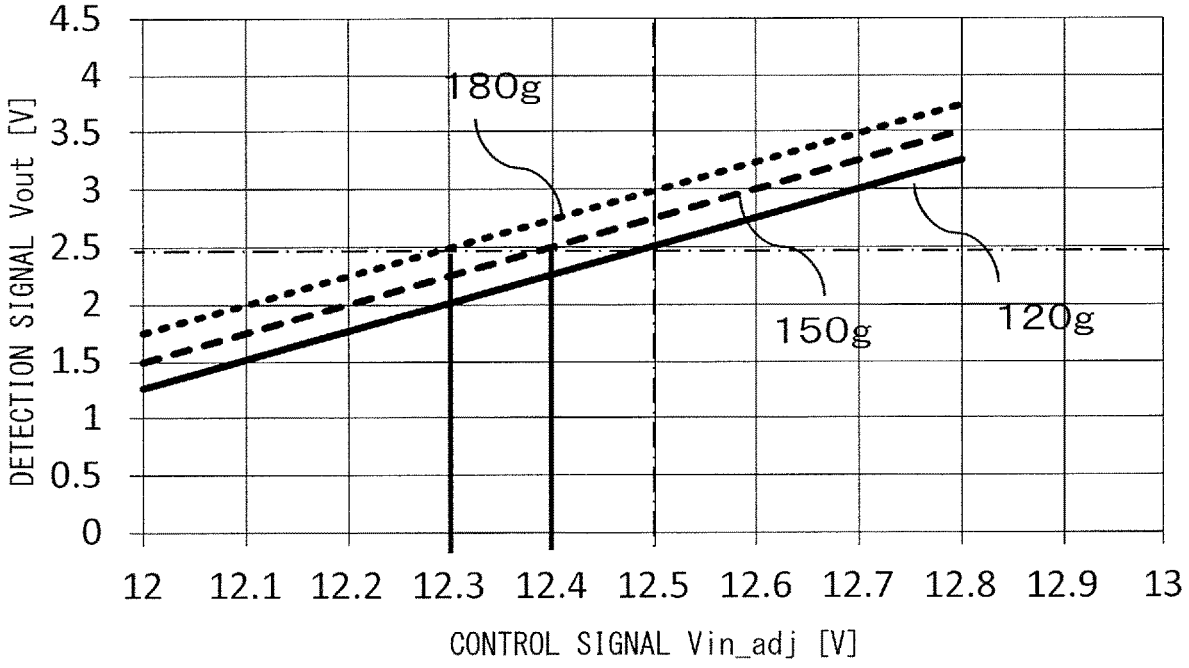
FIG. 12 is a graph illustrating a relationship between the control signal and the detection signal for explaining advantages of the first embodiment.

FIG. 12 illustrates a relationship between the control signal after adjustment and the detection signal for each of the different amounts of developer, which in the present example are 120 g, 150 g and 180 g. As can be recognized from FIG. 12, in order to obtain a detection signal corresponding to the same toner density even if the amount of developer fluctuates, such as to obtain a detection signal of 2.5 V at a toner density of 8%, it is preferred to adjust the control signal to 12.5 V when the amount of developer is 120 g corresponding to the initial amount of developer, to 12.4 V when the amount of developer is 150 g and to 12.3 V when the amount of developer is 180 g.

As described, according to the present embodiment, the influence of the change in the detection signal of the permeability sensor 45 accompanying the fluctuation of the amount of developer in the developing unit 4 can be attenuated by adjusting the control signal according to the amount of developer in the developing unit 4. That is, although the detection signal of the permeability sensor 45 varies depending on changes in toner density of developer, and also varies depending on fluctuation of the amount of developer in the developing unit 4, effects of the fluctuation of the amount of developer can be reduced. Thereby, even if the detection signal of the permeability sensor 45 has shifted because of the fluctuation of the amount (more specifically because of the fluctuation of the bulk density) of developer in the developing unit 4, advantageously, replenishment control can be executed appropriately based on the detection signal acquired by the permeability sensor 45.

Second Embodiment

Figure 13:
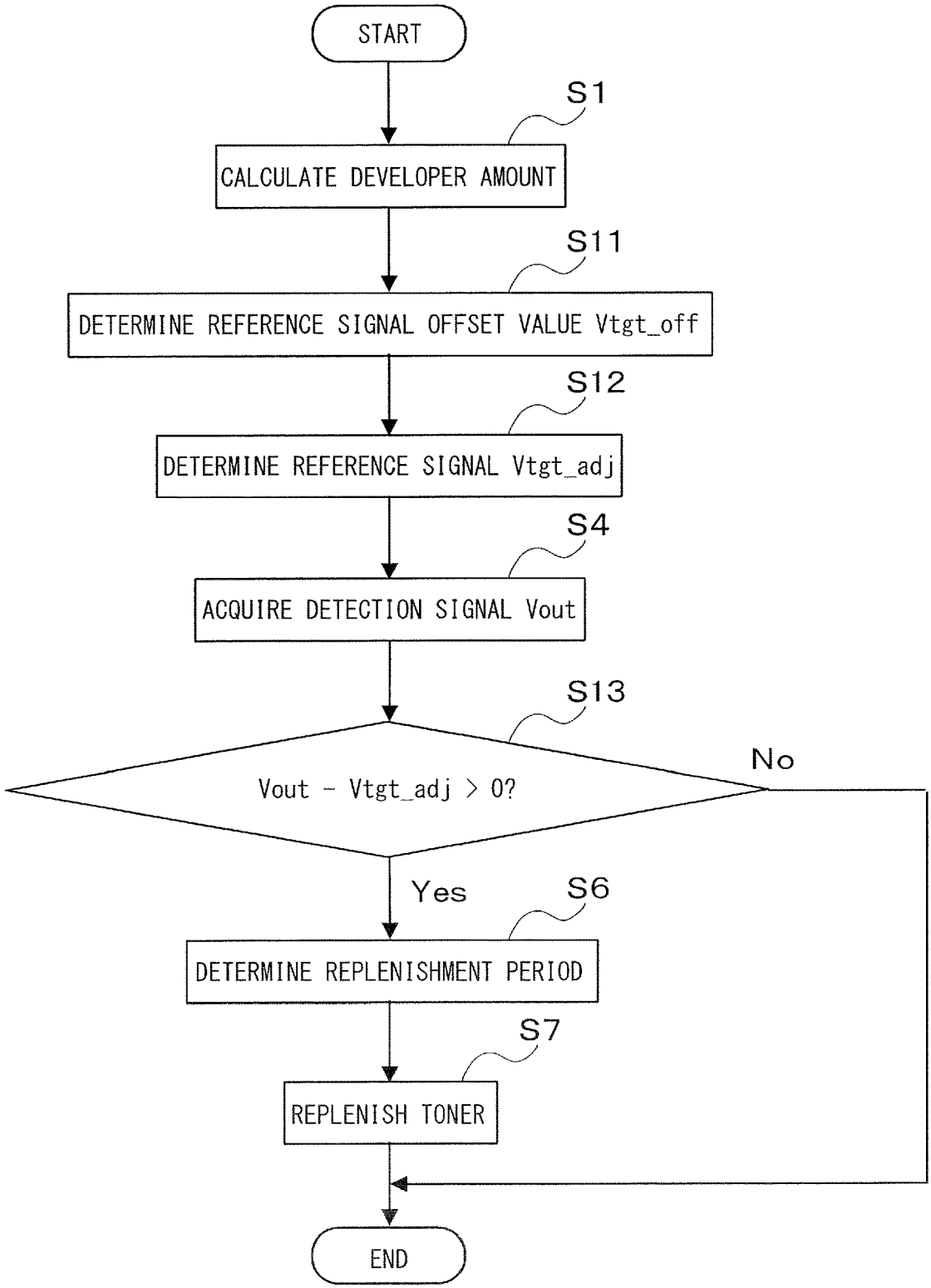
FIG. 13 is a flowchart illustrating an adjustment processing according to a second embodiment.

Next, an adjustment processing of a second embodiment will be described according to FIGS. 13 through 15 with reference to FIGS. 3 and 8. FIG. 13 illustrates an adjustment processing of the second embodiment. The adjustment processing of the second embodiment enables to execute replenishment control appropriately without adjusting the control signal of the permeability sensor 45 as according to the first embodiment and without correcting the detection signal of the permeability sensor 45 as described later (refer to FIG. 18). Hereafter, processes that differ from the first embodiment will be focused, and those similar to the first embodiment are denoted with the same reference numbers and descriptions thereof are omitted.

As illustrated in FIG. 13, the control unit 110 computes the amount of developer in the container 41, that is, in the developing unit (S1). The control unit 110 determines a reference signal offset value based on the amount of developer in the developing unit 4 (S11). The reference signal offset value is determined according to a table and the like defining the amount of developer and the reference signal offset value stored in advance in the ROM 113 or the like. FIG. 14 illustrates a relationship between the amount of developer and the reference signal offset value, i.e., adjustment value. In a case where the reference signal prior to adjustment is referred to as "Vtgt" and the reference signal offset value determined in accordance with the amount of developer is referred to as "Vtgt_off", the control unit 110 determines the reference signal after adjustment "Vtgt_adj" based on the following expression 2 (S12). Now, the reference signal prior to adjustment (2.5 V, for example) corresponds to the detection signal of the permeability sensor 45 that can be acquired by entering a predetermined control signal (12.5 V, for example) in a state where the developing unit 4 is new. In other words, the reference signal prior to adjustment corresponds to the target toner density (8%, for example) in the initial state.

$$Vtgt_adj = Vtgt + Vtgt_off \quad \text{Expression 2}$$

Figure 14:
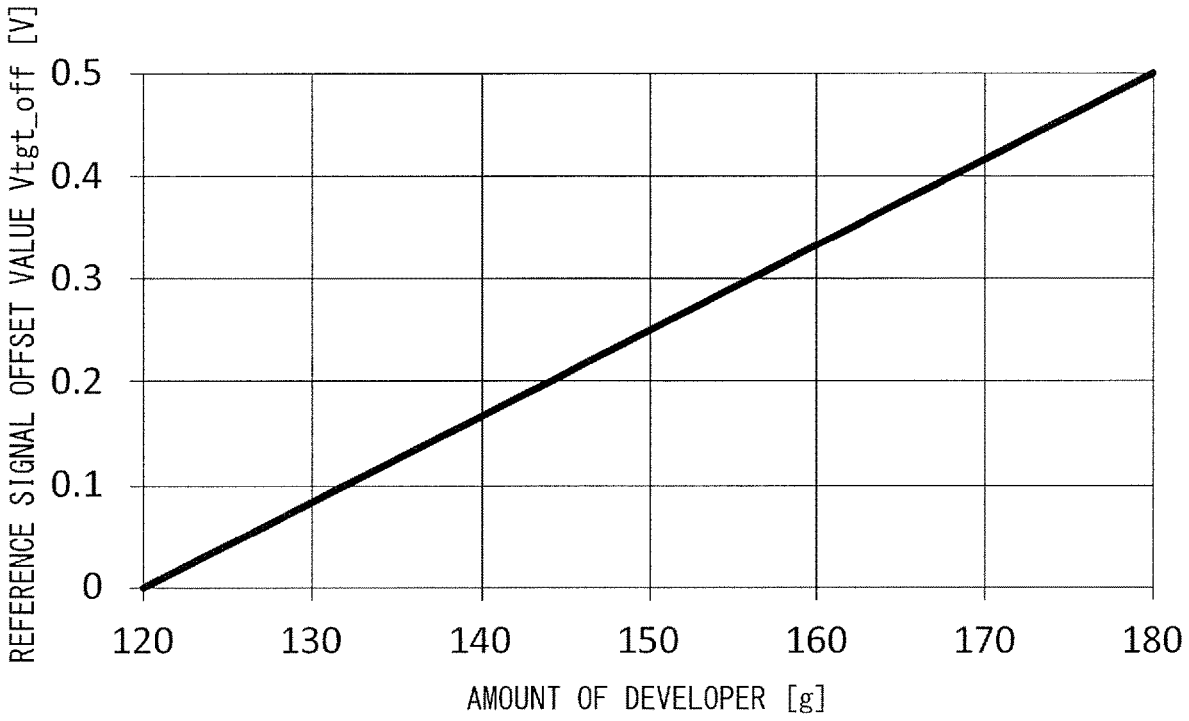
FIG. 14 is a graph illustrating a relationship between the amount of developer in the developing unit and an offset value of reference signal.

As illustrated in FIG. 14, when the amount of developer is 150 g, the control unit 110 determines the control signal offset value as "0.25". In that case, the control signal after adjustment (Vtgt_adj) will be "2.75 V". If the amount of developer is 180 g, the control unit 110 determines the control signal offset value as "0.5", so that the control signal after adjustment will be "3.0 V". As described, according to the control unit 110, the offset value (i.e., adjustment value) for changing the value of the control signal of a case where the amount of developer is 180 g (i.e., second agent quantity), which is greater than 150 g, is greater than the offset value of a case where the amount of developer is 150 g (i.e., first agent quantity), and the control signal is changed accordingly.

The present embodiment differs from the first embodiment in that the control unit 110 enters the control signal without adjustment (Vin) to the permeability sensor 45 and acquires the detection signal (Vout) obtained from the permeability sensor 45 (S4). Thereafter, the control unit 110 compares the acquired detection signal with the reference signal after adjustment (Vtgt_adj) (S13). If the difference between the detection signal and the reference signal after adjustment is 0 or smaller (S13: No), the control unit 110 ends the present processing without executing the replenishment control by the replenishment unit 8. Meanwhile, if the difference between the detection signal and the reference signal after adjustment is greater than 0 (S13: Yes), the control unit 110 executes replenishment control of the replenishing developer by the replenishment unit 8 (S6 and S7).

Figure 15:
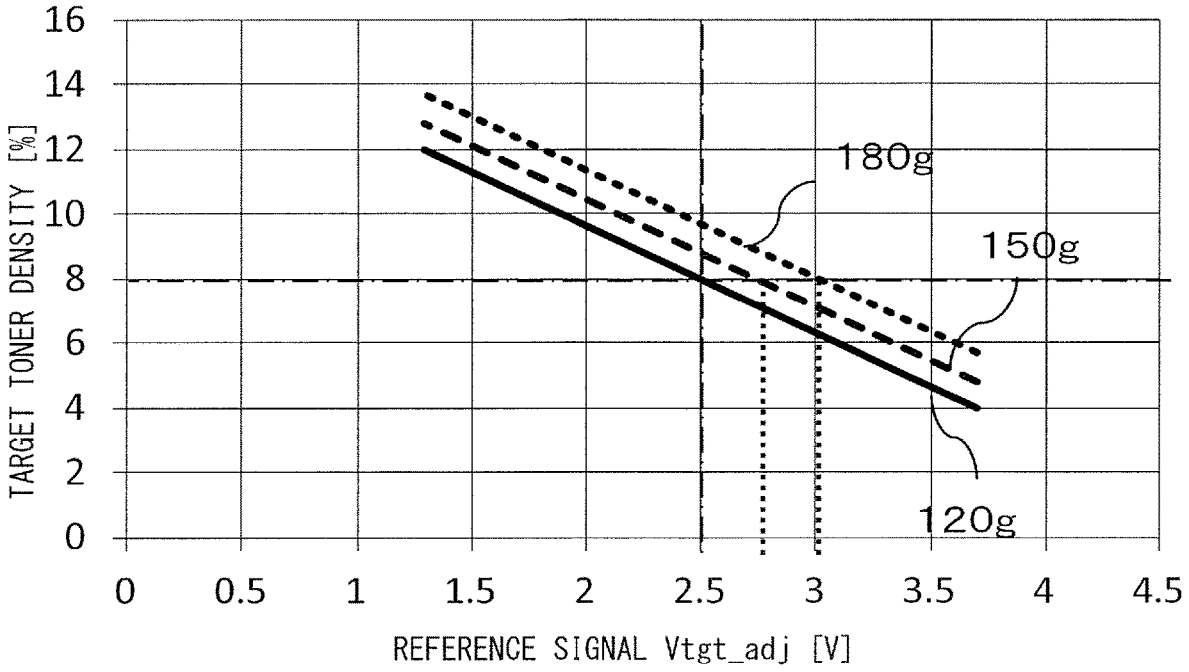
FIG. 15 is a graph illustrating a relationship between a reference signal and toner density for explaining advantages of the second embodiment.

FIG. 15 illustrates a relationship between the reference signal after adjustment and the target toner density for each of the different amounts of developer, which in the present example are 120 g, 150 g and 180 g. As can be recognized from FIG. 15, in order to obtain a reference signal of 2.5 V corresponding to a target toner density of 8% when the amount of developer is 120 g, that is, the initial amount of developer, the reference signal is changed to 2.75 V when the amount of developer is 150 g and to 3.0 V when the amount of developer is 180 g. When the amount of developer is 120 g, the toner density corresponding to the reference signal of 2.75 V is approximately 7%, and the toner density corresponding to the reference signal of 3.0 V is approximately 6%. Therefore, according to the second embodiment, the apparent target toner density is changed to compensate the variation of detection signal of the permeability sensor 45 that varies depending on the amount of developer even when the toner density is the same. Specifically, in a case where the amount of developer is 150 g, if the detection signal of the permeability sensor 45 is 2.75 V, then the target toner density (8%) of developer is detected, and replenishment control will not be executed. In a case where the amount of developer is 180 g, if the detection signal of the permeability sensor 45 is 3.0 V, then the target toner density (8%) is detected, and replenishment control will not be executed.

As described, according to the second embodiment, the influence of the change in the detection signal of the permeability sensor 45 accompanying the fluctuation of the amount of developer in the developing unit 4 can be reduced by adjusting the reference signal, i.e., reference value, according to the fluctuation of the amount of developer in the developing unit 4. In other words, a value of the reference signal used in the initial state where the first amount of the developer is contained in the container is different from a value of the reference signal used in a state where the second amount of the developer is contained in the container. The second amount is greater than the first amount, and is equal to the predetermined amount where discharge of developer starts, for example. Thereby, even if the detection signal of the permeability sensor 45 varies according to the fluctuation of the amount (more specifically the bulk density) of developer in the developing unit 4, advantageously, replenishment control can be executed appropriately based on the detection signal acquired by the permeability sensor 45.

Third Embodiment

In the case of the developing unit 4 of the embodiment described above, a configuration is adopted where developer is not discharged through the discharge portion 48 from the start of initializing operation until the amount of developer in the developing unit 4 increases from 120 g to 150 g. That is, in a period from the initial state where the initial amount of developer is enclosed to when the amount of developer increases to a predetermined amount and discharge of developer through the discharge portion 48 is started, the amount of discharge of developer is 0. Therefore, before discharge of developer through the discharge portion 48 is started (i.e., before the amount of developer having been replenished by the replenishment unit 8 reaches a third amount), the above-described adjustment processing can be executed based on the initial amount of developer, information regarding the amount of replenishing developer having been replenished by the replenishment unit 8, and information regarding the amount of toner having been consumed by image development, without considering the amount of discharged developer.

Figure 16:
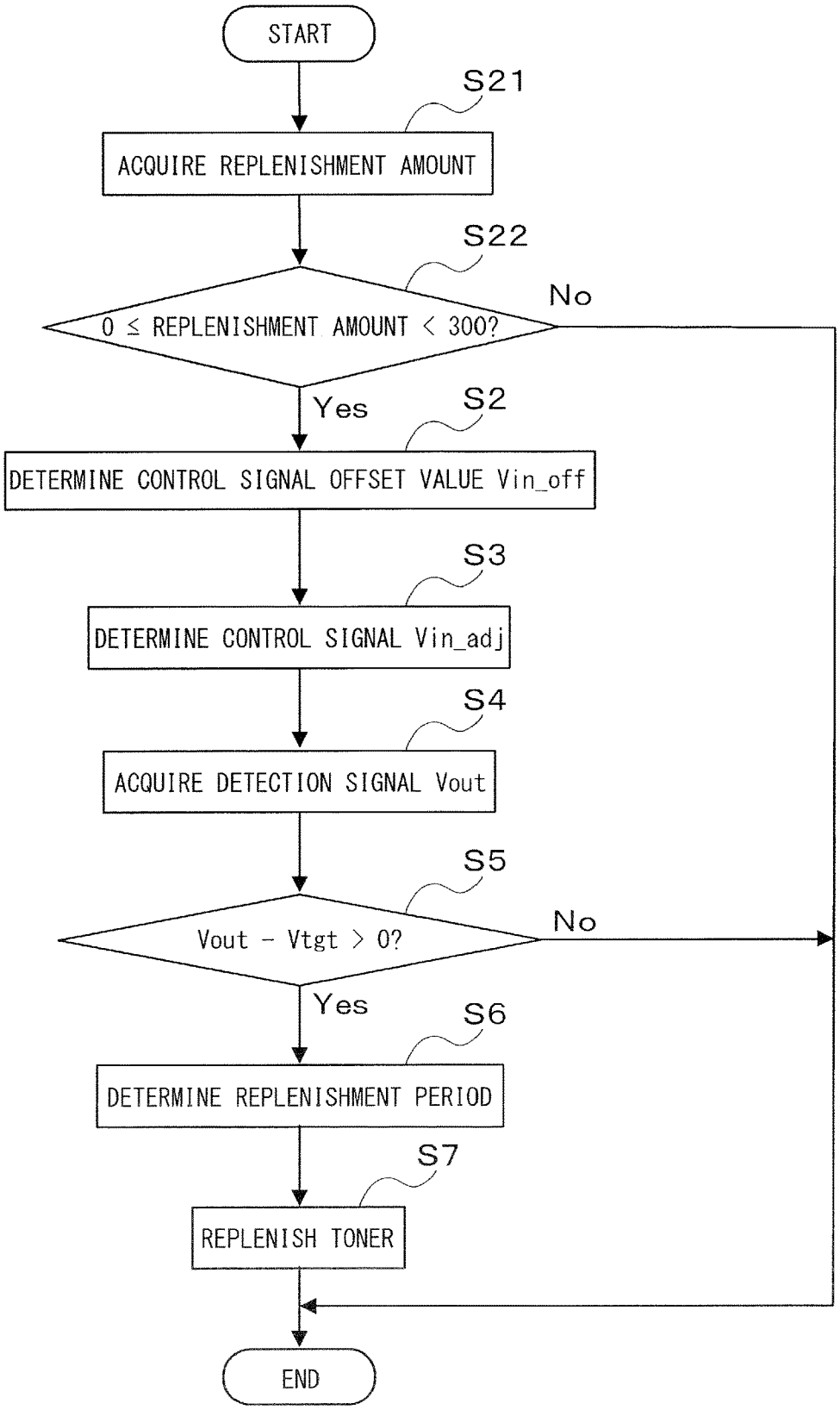
FIG. 16 is a flowchart illustrating an adjustment processing according to a third embodiment.

An adjustment processing of a third embodiment will be described according to FIGS. 16 and 17 with reference to FIGS. 3 and 8. Hereafter, processes that differ from the first embodiment will be focused, and the processes similar to the first embodiment are denoted with the same reference numbers and descriptions thereof are omitted. An example of a case where the control signal is adjusted by a control signal offset value is described, but the present invention is not restricted to this example, and the reference signal may be varied based the reference signal offset value, as described earlier.

The control unit 110 acquires an amount of replenishing developer having been replenished (S21). As described above, replenishing developer containing toner and carrier mixed at a weight ratio of 9:1 is replenished from the replenishment unit 8. Therefore, the amount of developer increases from 120 g to 150 g by the forming of images performed after the initializing operation approximately at a point of time when a total of 300 g of replenishing developer has been replenished, which corresponds to 270 g of amount of toner consumption. That is, the third amount of developer is 300 g in the present embodiment. If the amount of replenishment after the initialization operation is 0 or greater and smaller than 300 g (S22: Yes), the control unit 110 determines the control signal offset value based on the amount of developer in the developing unit 4 (S2). However, according to the present embodiment, the control signal offset value is determined based on a table defining the relationship between the amount of replenishing developer having been replenished and the control signal offset value stored in advance in the ROM 113 or the like. FIG. 17 illustrates a relationship between the amount of replenishment and the control signal offset value.

Figure 17:
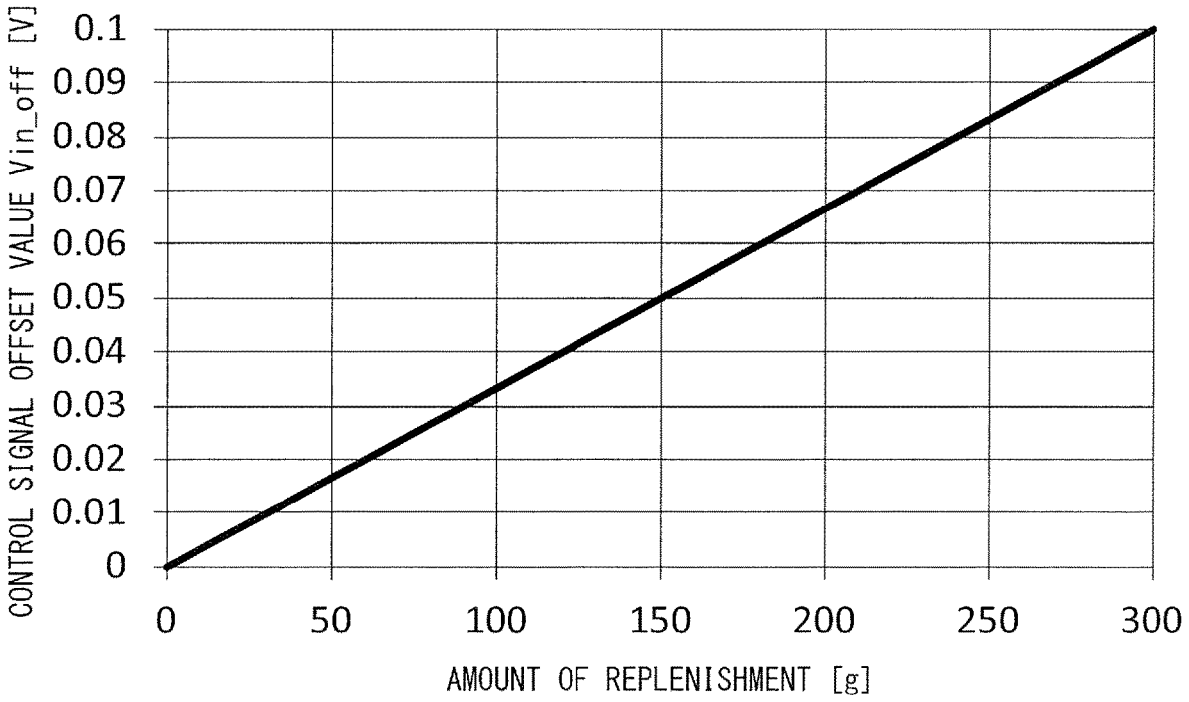
FIG. 17 is a graph illustrating a relationship between an estimated amount of replenishment and an offset value of the control signal.

When the amount of replenishing developer having been replenished is 150 g, as illustrated in FIG. 17, the control unit 110 determines the control signal offset value as "0.05". In that case, the control signal after adjustment (Vin_adj) will be "12.45 V". Further, if the amount of replenishing developer having been replenished is 300 g, the control unit 110 determines the control signal offset value as "0.1", so that the control signal after adjustment will be "12.4 V". As descried, the offset value is higher in a case where the amount of replenishment is 300 g, which is 150 g greater than the offset value of a case where the amount of replenishment is 150 g, and the control signal is changed accordingly by the control unit 110.

Meanwhile, if the amount of replenishment after initializing operation is 300 g or greater (S22: No), the control unit 110 ends the adjustment processing. In that case, the amount of developer becomes 150 g or greater and the discharge of developer from the discharge portion 48 is started, so that the above-described adjustment processing according to the first embodiment should be executed.

After determining the control signal offset value, the control unit 110 determines the control signal after adjustment "Vin_adj" based on expression 1 described above (S3). Then, the control unit 110 enters the control signal after adjustment (Vin_adj) to the permeability sensor 45, acquires the detection signal (Vout) obtained from the permeability sensor 45 (S4), and compares the same with the reference signal (Vtgt, for example, 2.5 V) (S5). If the difference between the detection signal and the reference signal is 0 or below (S5: No), the control unit 110 ends the present processing without executing replenishment control by the replenishment unit 8. On the other hand, if the difference between the detection signal and the reference signal is greater than 0 (S5: Yes), the control unit 110 executes replenishment control of replenishing developer by the replenishment unit 8 (S6 and S7).

As described, according to the present embodiment, by adjusting the control signal (or by changing the reference signal), the influence of the change of detection signals of the permeability sensor 45 accompanying the fluctuation of the amount of developer in the developing unit 4 can be reduced. Thereby, even if the detection signal of the permeability sensor 45 is changed according to the fluctuation of the amount of developer (more specifically, the bulk density of developer) in the developing unit 4, replenishment control can be executed appropriately according to the detection signal acquired from the permeability sensor 45.

Fourth Embodiment

Figure 18:
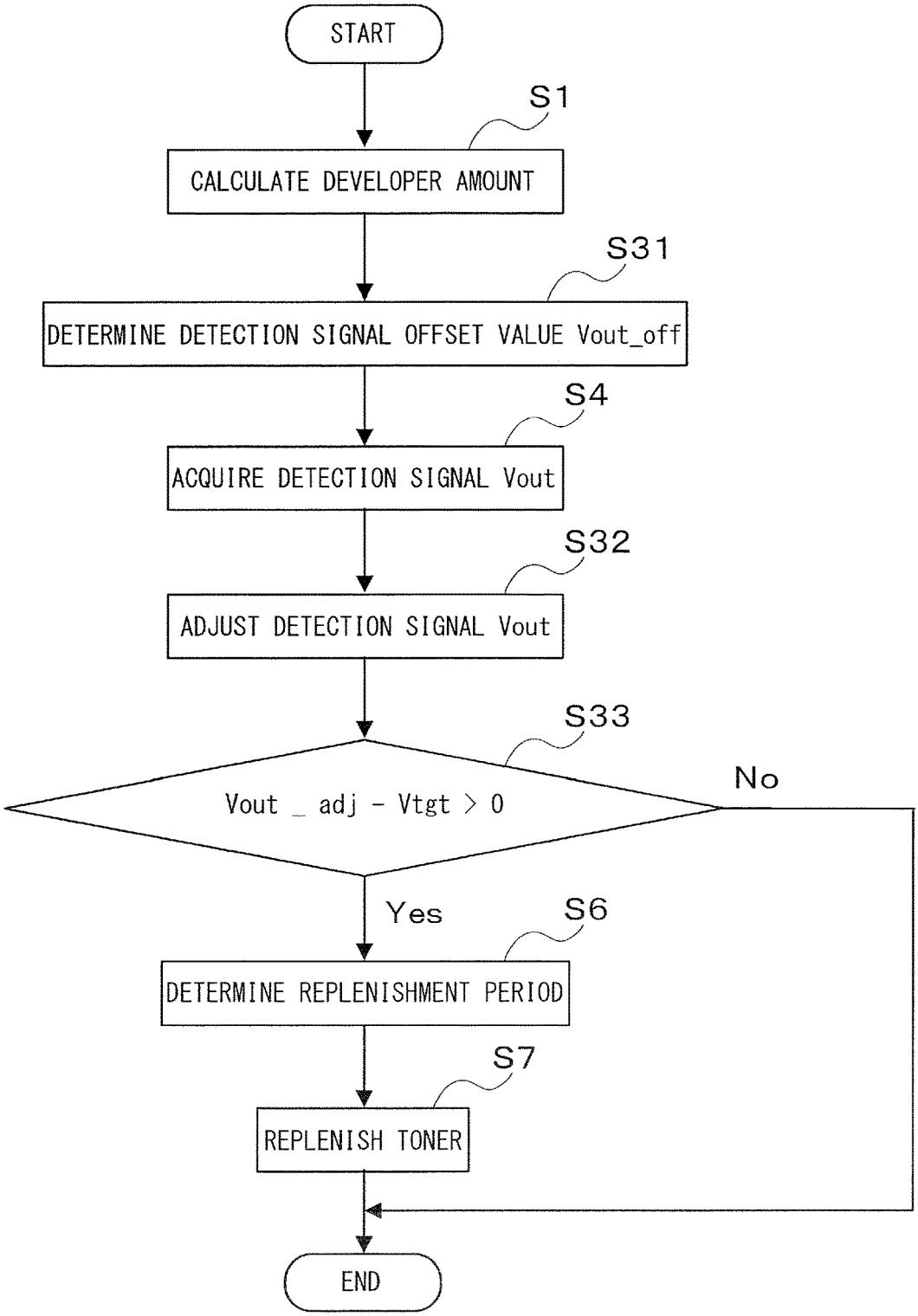
FIG. 18 is a flowchart illustrating an adjustment processing of a fourth embodiment.

According to the first to third embodiments described above, the influence of the change of detection signal of the permeability sensor 45 accompanying the fluctuation of the amount of developer in the developing unit 4 can be reduced by adjusting the control signal or changing the reference signal, by which adjustment control can be executed appropriately, but the present technique is not restricted to these examples. For example, the detection signal of the permeability sensor 45 can be adjusted to correspond to the fluctuation of the amount of developer in the developing unit 4. The adjustment processing of a fourth embodiment of such case will be described according to FIGS. 18 and 19 with reference to FIGS. 3 and 8. FIG. 18 illustrates an adjustment processing according to a fourth embodiment. Processes that differ from the first embodiment will mainly be focused, and the processes similar to the first embodiment are denoted with the same reference numbers and descriptions thereof are omitted.

Figure 19:
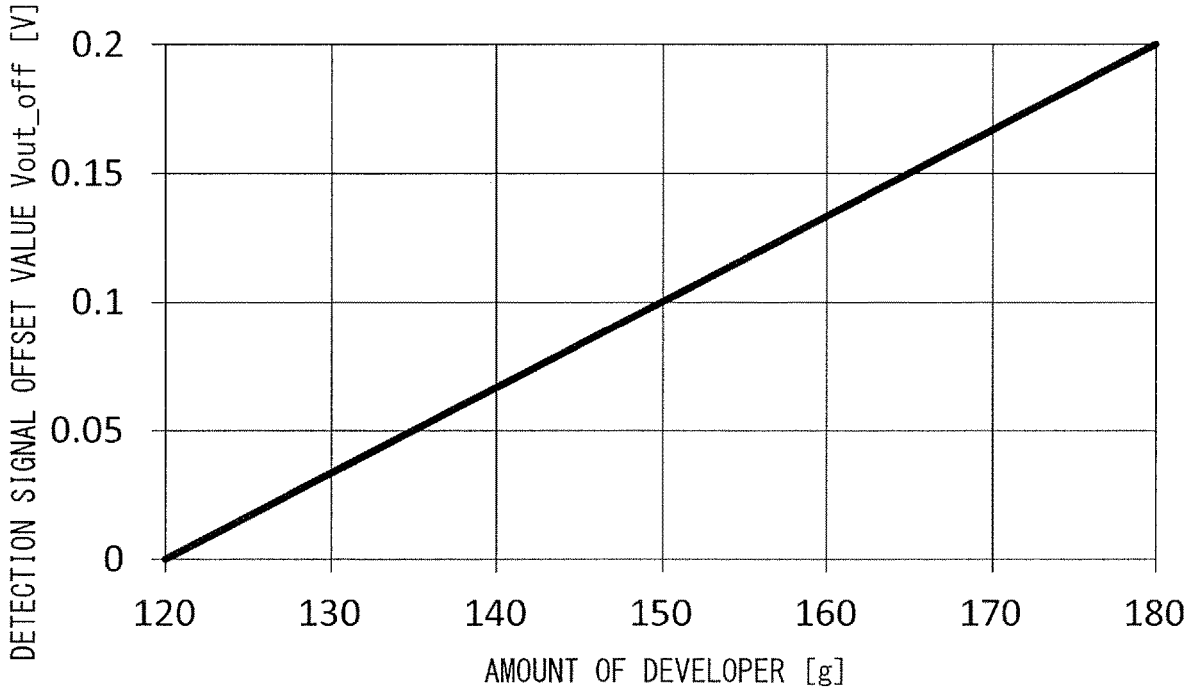
FIG. 19 is a graph illustrating a relationship between an amount of developer in the developing unit and an offset value of a detection signal.

As illustrated in FIG. 18, the control unit 110 computes an amount of developer in the container 41, that is, in the developing unit (S1). The control unit 110 determines a detection signal offset value based on the amount of developer in the developing unit 4 (S31). The detection signal offset value is determined based on a table or the like, which defines the relationship between the amount of developer and the detection signal offset value, stored in advance in the ROM 113 or the like. FIG. 19 illustrates the relationship between the amount of developer and the detection signal offset value.

As illustrated in FIG. 19, when the amount of developer is 150 g, the control unit 110 determines the detection signal offset value as "0.1". When the amount of developer is 180 g, the control unit 110 determines the detection signal offset value as "0.2". As described, the offset value (i.e., adjustment value) of a case where the amount of developer is 180 g (i.e., second agent quantity), which is greater than 150 g, is greater than a case where the amount of developer is 150 g (i.e., first agent quantity), and the control unit 110 changes the detection signal corresponding thereto.

The present embodiment differs from the first embodiment in that the control signal before adjustment (Mn) is sent from the control unit 110 to the permeability sensor 45 and the detection signal (Vout) acquired in response from the permeability sensor 45 (S4) is obtained. Then, defining the detection signal before adjustment as "Vout" and the detection signal offset value determined based on the amount of developer as "Vout_off", the control unit 110 adjusts the detection signal (Vout) obtained from the permeability sensor 45 based on the following expression 3 (S32).

$$V_{out_adj} = V_{out} - V_{out_off} \qquad \text{Expression 3}$$

The control unit 110 compares the detection signal after adjustment (Vout_adj) and the reference signal (Vtgt) (S33). If the difference between the detection signal after adjustment and the reference signal is 0 or smaller (S33: No), the control unit 110 ends the present processing without executing replenishment control by the replenishment unit 8. On the other hand, if the difference between the detection signal after adjustment and the reference signal is greater than 0 (S33: Yes), the control unit 110 executes replenishment control of replenishing developer by the replenishment unit 8 (S6 and S7).

As described, according to the present embodiment, the influence of the change of detection signal is reduced by adjusting the detection signal of the permeability sensor 45 that is influenced by the fluctuation of the amount of developer in the developing unit 4. Thereby, even if the detection signal of the permeability sensor 45 is changed according to the fluctuation of the amount of developer (more specifically the bulk density of developer) in the developing unit 4, replenishment control can be executed appropriately based on the detection signal acquired by the permeability sensor 45.

According to the embodiments described above, it is stated that the discharge of developer is started when the amount of developer in the developing unit reaches 150 g or greater, but there may be a case where a small amount of developer discharge, such as 30 mg/min or smaller, occurs due to developer leak even when the amount of developer in the developing unit is smaller than 150 g. Such minute developer leak should not be considered as amount of discharge.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s)

and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-020398, filed on Feb. 7, 2018, which is hereby incorporated by reference herein in its entirety.

What is claimed is:

1. An image forming apparatus comprising:

a developer bearing member configured to bear developer including toner and carrier to develop an electrostatic latent image on an image bearing member;

a developer container configured to contain the developer that is supplied to the developer bearing member;

a permeability sensor configured to detect information on magnetic permeability of the developer contained in the developer container for detecting toner density of the developer contained in the developer container;

a developer replenishing portion configured to replenish the developer container with the developer based on the information on the magnetic permeability of the developer contained in the developer container detected by the permeability sensor;

a developer discharging portion configured to discharge a portion of the developer contained in the developer container; and a controller configured to control a control voltage applied to the permeability sensor, wherein a first value of the control voltage that is applied to the permeability sensor in a case where an amount of the developer contained in the developer container is a first amount and the toner density of the developer contained in the developer container is a first density is greater than a second value of the control voltage that is applied to the permeability sensor in a case where the amount of the developer contained in the developer container is a second amount greater than the first amount and the toner density of the developer contained in the developer container is a second density equal to the first density.

2. The image forming apparatus according to claim 1, wherein a third value of the control voltage that is applied to the permeability sensor in a case where the amount of the developer contained in the developer container is a third amount greater than the second amount and the toner density of the developer contained in the developer container is a third density equal to the second density is less than the second value of the control voltage that is applied to the permeability sensor.

3. The image forming apparatus according to claim 1, wherein in a case where the amount of the developer contained in the developer container is the second amount, a portion of the developer contained in the developer container is discharged from the developer container through the developer discharging portion.

4. The image forming apparatus according to claim 3, wherein in a case where the amount of the developer contained in the developer container is the first amount, the developer contained in the developer container is not discharged from the developer container through the discharging portion.

5. The image forming apparatus according to claim 1, wherein the first amount is an amount of initial developer contained in the developer container in a state that a developing assembly including the developer container and the developer bearing member is new.

6. The image forming apparatus according to claim 5, wherein the developer container includes a first chamber configured to supply the developer to the developer bearing member and a second chamber separated from the first chamber by a partition wall and configured to form a circulation path of the developer together with the first chamber, and wherein in a state that the developing assembly is new, the initial developer is sealed in the second chamber.

7. The image forming apparatus according to claim 1, wherein the first amount is 80% of the second amount or less.

8. The image forming apparatus according to claim 1, wherein the first amount is less than 150 grams.

9. The image forming apparatus according to claim 1, wherein the second amount is 150 grams or greater.

* * * * *